US011976427B2

(12) United States Patent
Nguyendinh et al.

(10) Patent No.: US 11,976,427 B2
(45) Date of Patent: May 7, 2024

(54) CONNECTION ASSEMBLY, LEVELLING OR LIFTING SYSTEM, AND METHOD OF LEVELLING A SLAB

(71) Applicants: NANYANG TECHNOLOGICAL UNIVERSITY, Singapore (SG); TUM CREATE LIMITED, Singapore (SG)

(72) Inventors: Nen Nguyendinh, Singapore (SG); Oscar Augusto Cesar Amestegui Aguilar, Singapore (SG); Ali Aryo Bawono, Singapore (SG); Bernhard Lechner, Singapore (SG)

(73) Assignees: NANYANG TECHNOLOGICAL UNIVERSITY, Singapore (SG); TUM CREATE LIMITED, Singapore (SG)

( * ) Notice: Subject to any disclaimer, the term of this patent is extended or adjusted under 35 U.S.C. 154(b) by 318 days.

(21) Appl. No.: 17/432,770

(22) PCT Filed: Feb. 12, 2020

(86) PCT No.: PCT/SG2020/050068

§ 371 (c)(1),
(2) Date: Aug. 20, 2021

(87) PCT Pub. No.: WO2020/171775

PCT Pub. Date: Aug. 27, 2020

(65) Prior Publication Data

US 2022/0145553 A1 May 12, 2022

(30) Foreign Application Priority Data

Feb. 22, 2019 (SG) ..... 10201901575W

(51) Int. Cl.

| | |
|---|---|
| ***E01C 23/10*** | (2006.01) |
| ***E04G 21/10*** | (2006.01) |
| ***E04G 21/14*** | (2006.01) |

(52) U.S. Cl.
CPC ..... *E01C 23/10* (2013.01); *E04G 21/10* (2013.01); *E04G 21/142* (2013.01)

(58) Field of Classification Search
CPC ..... E01C 23/10; E04G 21/10; E04G 21/142
(Continued)

(56) References Cited

U.S. PATENT DOCUMENTS

| | | | |
|---|---|---|---|
| 7,836,659 | B1 | 11/2010 | Barnes |
| 9,003,720 | B2 | 4/2015 | Siqueiros |

(Continued)

FOREIGN PATENT DOCUMENTS

| | | | |
|---|---|---|---|
| DE | 8816398 | U1 | 7/1989 |
| KR | 10-2016-0111753 | A | 9/2016 |

OTHER PUBLICATIONS

Gracie Leveling Lift™: Products, © 2021 Gracie Leveling Lift [http://gracielevelinglift.com/products/, accessed Mar. 4, 2015], 1 page.

*Primary Examiner* — Mark R Wendell
(74) *Attorney, Agent, or Firm* — Seed IP Law Group LLP

(57) ABSTRACT

A connection assembly for connecting a bolt to a slab includes a first connection part and a second connection part. The first connection part and the second connection part may be capable of being assembled to the slab in a manner so as to sandwich the slab with a first clamping member of the first connection part and a second clamping member of the second connection part between two opposite surfaces of the slab. The first connection part and the second connection part may be connected in a manner such that a connection between a first hollow-tubular-connecting-structure of the first connection part and a second hollow-tubular-connecting-structure of the second connection part may be within a through-hole in the slab, which extends between the two opposite surfaces of the slab.

20 Claims, 18 Drawing Sheets

(58) Field of Classification Search
USPC ..... 52/704
See application file for complete search history.

(56) References Cited

U.S. PATENT DOCUMENTS

| | | | | |
|---|---|---|---|---|
| 9,347,232 | B1 | 5/2016 | Francies, III | |
| 9,556,566 | B2 | 1/2017 | Sanders | |
| 2014/0053475 | A1* | 2/2014 | Siqueiros | E04G 21/142 52/125.4 |
| 2015/0059261 | A1 | 3/2015 | Siqueiros | |
| 2015/0284915 | A1* | 10/2015 | Sanders | E01C 23/00 404/73 |
| 2019/0048532 | A1 | 2/2019 | Smith | |

* cited by examiner

CONNECTION ASSEMBLY, LEVELLING OR LIFTING SYSTEM, AND METHOD OF LEVELLING A SLAB

TECHNICAL FIELD

Various embodiments generally relate to a connection assembly, a levelling or lifting system, and a method of levelling a slab (e.g. concrete slab).

BACKGROUND

Precast slabs (e.g. concrete slabs, stone slabs etc.) have commonly been used in installation of pavements or roads, by bonding the precast slabs onto an asphalt surface that had already been prepared to form pavements or roads.

A known pavement or road installation system that involves the use of precast slabs is the Precast Ultra-thin Whitetopping (PUTW) system.

The PUTW system is relatively cost-effective, time-saving and results in installed pavements or roads that are durable. This makes the PUTW system suitable for installation of pavements or roads in areas where vehicle traffic is high and which encounter numerous heavy vehicles halting temporarily, for example, at a traffic junction or for picking up/dropping off passenger(s).

The PUTW system involves conventional lifting and levelling devices, already embedded at four corners of each precast slab, for attaching an eye bolt or a through-bolt to each of the conventional lifting and levelling devices for lifting or levelling of the precast slabs via the eye bolt or the through-bolt.

The installation of pavement or roads often involves working on areas having complex geometries which necessitates a precast slab (of standard size) being cut into a smaller slab with only three or less than three conventional lifting and levelling devices mentioned remaining on the cut-up smaller slab. However, these three or less than three conventional lifting and levelling devices remaining on the cut-up smaller slab are insufficient for lifting and levelling the cut-up smaller slab safely.

Moreover, it is commonly the case that at least one of the conventional lifting and levelling device mentioned above arrive in a spoilt condition prior to installation, for example with spoilt threads such that a threaded bolt cannot be threaded thereto, or become spoilt during the installation process when wet concrete enters the lifting and levelling device to prevent the bolt from being attached thereto.

Accordingly, there is a need for a more reliable and effective solution for lifting and/or levelling of a slab.

SUMMARY

According to various embodiments, a connection assembly for connecting a bolt to a slab may be provided. The connection assembly may include a first connection part. The first connection part may include a first clamping member and may include a first hollow-tubular-connecting-structure extending from the first clamping member. According to various embodiments, the first hollow-tubular-connecting-structure may have a threaded interior wall surface and an exterior wall surface having a first engagement element. The connection assembly may further include a second connection part. The second connection part may include a second clamping member and may include a second hollow-tubular-connecting-structure extending from the second clamping member. According to various embodiments, the second hollow-tubular-connecting-structure may have an interior wall surface having a second engagement element. According to various embodiments, an inner diameter of the second hollow-tubular-connecting-structure may be equal or larger than an outer diameter of the first hollow-tubular-connecting-structure. According to various embodiments, the second clamping member may include an opening providing access to an inner cavity of the second hollow-tubular-connecting-structure. According to various embodiments, the first connection part and the second connection part may be connectable to each other with the first hollow-tubular-connecting-structure of the first connection part and the second hollow-tubular-connecting-structure of the second connection part aligned along a connection axis and directed towards each other such that the first hollow-tubular-connecting-structure may be insertable into the second hollow-tubular-connecting-structure to form a connection along the connection axis with the first engagement element of the exterior wall surface of the first hollow-tubular-connecting-structure and the second engagement element of the interior wall surface of the second hollow-tubular-connecting-structure engaged to each other.

According to various embodiments, the first connection part and the second connection part may be capable of being assembled to the slab in a manner so as to sandwich the slab between the first clamping member and the second clamping member between two opposite surfaces of the slab and with the connection axis of the connection between the first hollow-tubular-connecting-structure and the second hollow-tubular-connecting-structure extending through a through-hole in the slab which extends between the two opposite surfaces of the slab, whereby the bolt may be connectable to the slab with the connection assembly by screwing the bolt into the first hollow-tubular-connecting-structure of the first connection part for threaded engagement with the threaded interior wall surface of the first hollow-tubular-connecting-structure through the opening of the second clamping member of the second connection part.

BRIEF DESCRIPTION OF THE DRAWINGS

In the drawings, like reference characters generally refer to the same parts throughout the different views. The drawings are not necessarily to scale, emphasis instead generally being placed upon illustrating the principles of the invention. In the following description, various embodiments are described with reference to the following drawings, in which.

DETAILED DESCRIPTION

Figure 1A:
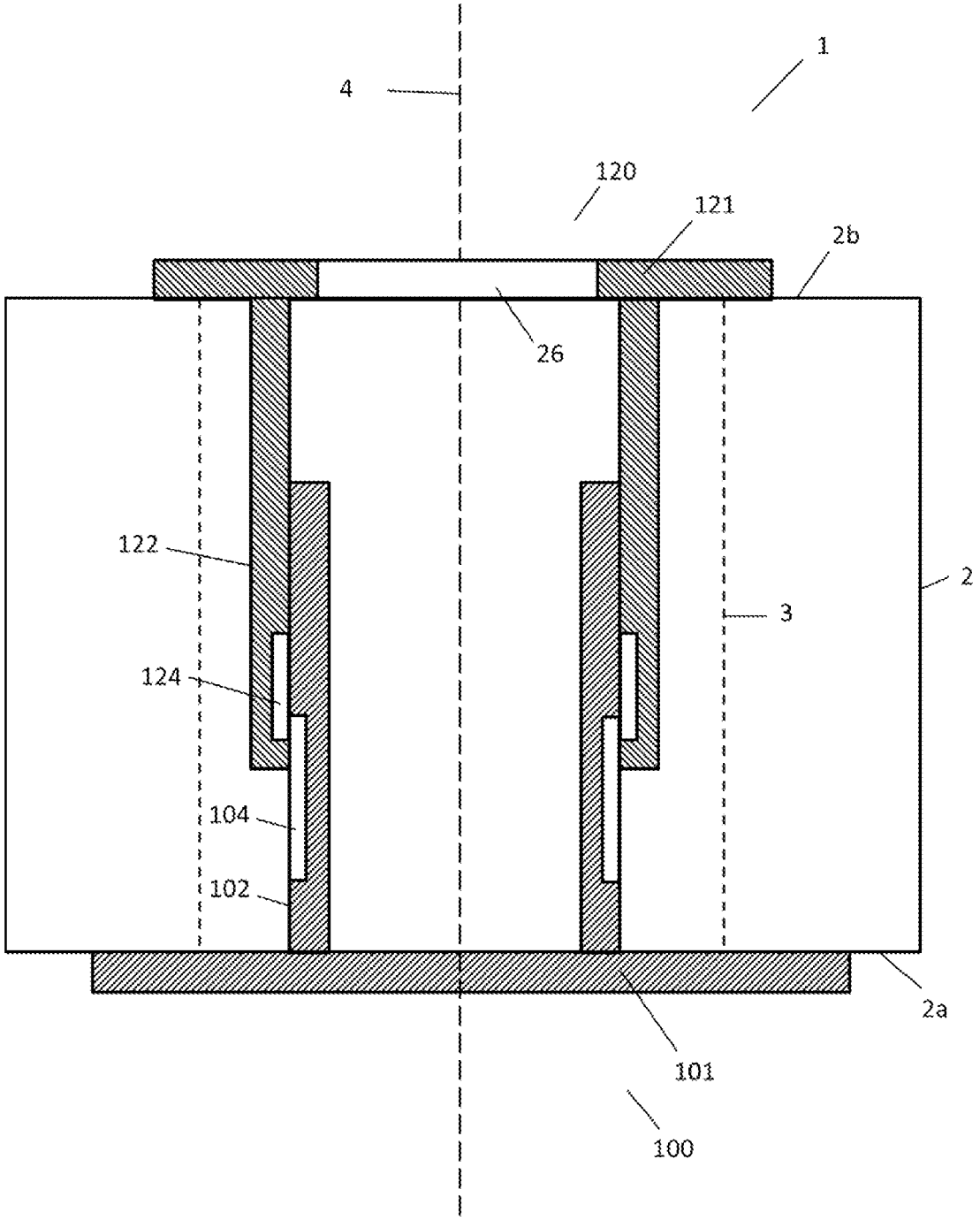
FIG. 1A shows a schematic view of a connection assembly assembled to a slab according to various embodiments.

The following detailed description refers to the accompanying drawings that show, by way of illustration, specific details and embodiments in which the invention may be practiced. These embodiments are described in sufficient detail to enable those skilled in the art to practice the invention. Other embodiments may be utilized and structural, and logical changes may be made without departing from the scope of the invention. The various embodiments are not necessarily mutually exclusive, as some embodiments can be combined with one or more other embodiments to form new embodiments.

Embodiments described below in the context of the apparatus are analogously valid for the respective methods, and vice versa. Furthermore, it will be understood that the embodiments described below may be combined, for example, a part of one embodiment may be combined with a part of another embodiment.

It should be understood that the terms "on", "over", "top", "bottom", "down", "side", "back", "left", "right", "front", "lateral", "side", "up", "down" etc., when used in the following description are used for convenience and to aid understanding of relative positions or directions, and not intended to limit the orientation of any device, or structure or any part of any device or structure. In addition, the singular terms "a", "an", and "the" include plural references unless context clearly indicates otherwise. Similarly, the word "or" is intended to include "and" unless the context clearly indicates otherwise.

Various embodiments generally relate to a connection assembly capable of being retrofitted to a slab (e.g. concrete slab, stone slab or precast slab of any material), in particular, to an already hardened or solid slab, for connecting a bolt (e.g. threaded bolt, lifting bolt and/or levelling bolt) to the slab for subsequent lifting or levelling of the slab via the bolt. In various embodiments, the connection assembly may be assembled or fitted onto the slab. The bolt may then be connected or joined to the connection assembly so as to be connected to the slab. Various embodiments generally also relate to a levelling or lifting system and a method of levelling a slab.

According to various embodiments, the connection assembly may include a first connection part that is connectable or couplable to a second connection part. The first connection part may be a separate entity from the second connection part. The first connection part may include a first clamping member and a first hollow-tubular-connecting-structure with a first engagement element. The second connection part may include a second clamping member and a second hollow-tubular-connecting-structure with a second engagement element. According to various embodiments, to retrofit the connection assembly to an already hardened slab, the first connection part may be connected or coupled to the second connection part by sandwiching the already hardened slab between the first clamping member and the second clamping member via inserting the first hollow-tubular-connecting-structure of the first connection part into a through-hole in the already hardened slab and inserting the second hollow-tubular-connecting-structure of the second connection part into the same through-hole in a manner so as to connect the first hollow-tubular-connecting-structure and the second hollow-tubular-connecting-structure to form a connection within the through-hole of the already hardened slab. According to various embodiments, connecting the first hollow-tubular-connecting-structure and the second hollow-tubular-connecting-structure may include engaging the first engagement element of the first hollow-tubular-connecting-structure and the second engagement element of the second hollow-tubular-connecting-structure to each other.

According to various embodiments, when the connection assembly is retrofitted to the already hardened slab, with the already hardened slab sandwiched between the first clamping member and the second clamping member, the connection between the first hollow-tubular-connecting-structure and second hollow-tubular-connecting-structure may not engage or may not be coupled or may not be in contact with any portion (e.g. solid portion) of the hardened slab or the through-hole of the hardened slab. Thus, according to various embodiments, the connection assembly may be retrofitted to the already hardened slab with only the first clamping member and the second clamping member (and no other supporting member, element or coupler etc.) in engagement or contact with the already hardened slab between two opposite surfaces of the slab.

Once the connection assembly, according to various embodiments, is retrofitted to any already hardened slab, a bolt (e.g. threaded bolt, lifting bolt, levelling bolt) may be inserted into the connection assembly such that the bolt is threadedly engaged with the connection assembly. According to various embodiments, the bolt may be configured for subsequent lifting or levelling of the slab.

According to various embodiments, the levelling or lifting system may include the slab (e.g. already hardened slab), the connection assembly retrofitted to the slab and the bolt. According to various embodiments, when the slab is lifted or levelled via the bolt threadedly engaged with the connection assembly, the slab may be supported during the lifting or levelling by only the first clamping member and the second clamping member sandwiching the slab between the two opposite surfaces of the slab, with no other supporting member, element or coupler etc. in contact with either one or both of the slab and the connection assembly.

Advantageously, by being capable of retrofitting the connection assembly according to various embodiments to an already hardened slab, the process of casting a slab (e.g. precast slab) may be free of embedding the conventional lifting and levelling device into the precast slab (in other words, the conventional lifting and levelling device may not be present during the process of casting the slab). In other words, a slab is not cast (or precast) with the conventional lifting and levelling device embedded therein. Rather, according to various embodiments, the connection assembly may be retrofitted (e.g. detachably attached) to the already hardened precast slab.

Further, advantageously, with the connection assembly according to various embodiments, precast slabs of a standard size may be prepared for use with the connection assembly, instead of casting or preparing customized shaped or sized slab(s) (e.g. having lifting or levelling devices embedded therein) to fit or match worksite geometry. The prepared precast slabs of standard size may be cut to desired dimension(s) on-site and, thereafter, be retrofitted with the connection assembly according to various embodiments. The use of precast slabs of standard size results in cost savings as a result of reduced formwork.

Further, advantageously, leftover slabs from cutting up the standard-sized precast slabs to desired sizes, such that the leftover slabs are of non-standard sizes from standard-sized precast slabs, may be retrofitted with the connection assembly according to various embodiments, thereby reducing wastage of slab material.

Moreover, with the connection assembly according to various embodiments, the lifting or levelling points (i.e. where respective connection assemblies are retrofitted to a slab) may be chosen on-site (or may be adjusted and repositioned on-site) simply by retrofitting respective connection assemblies to desired positions on the slab.

Figure 1B:
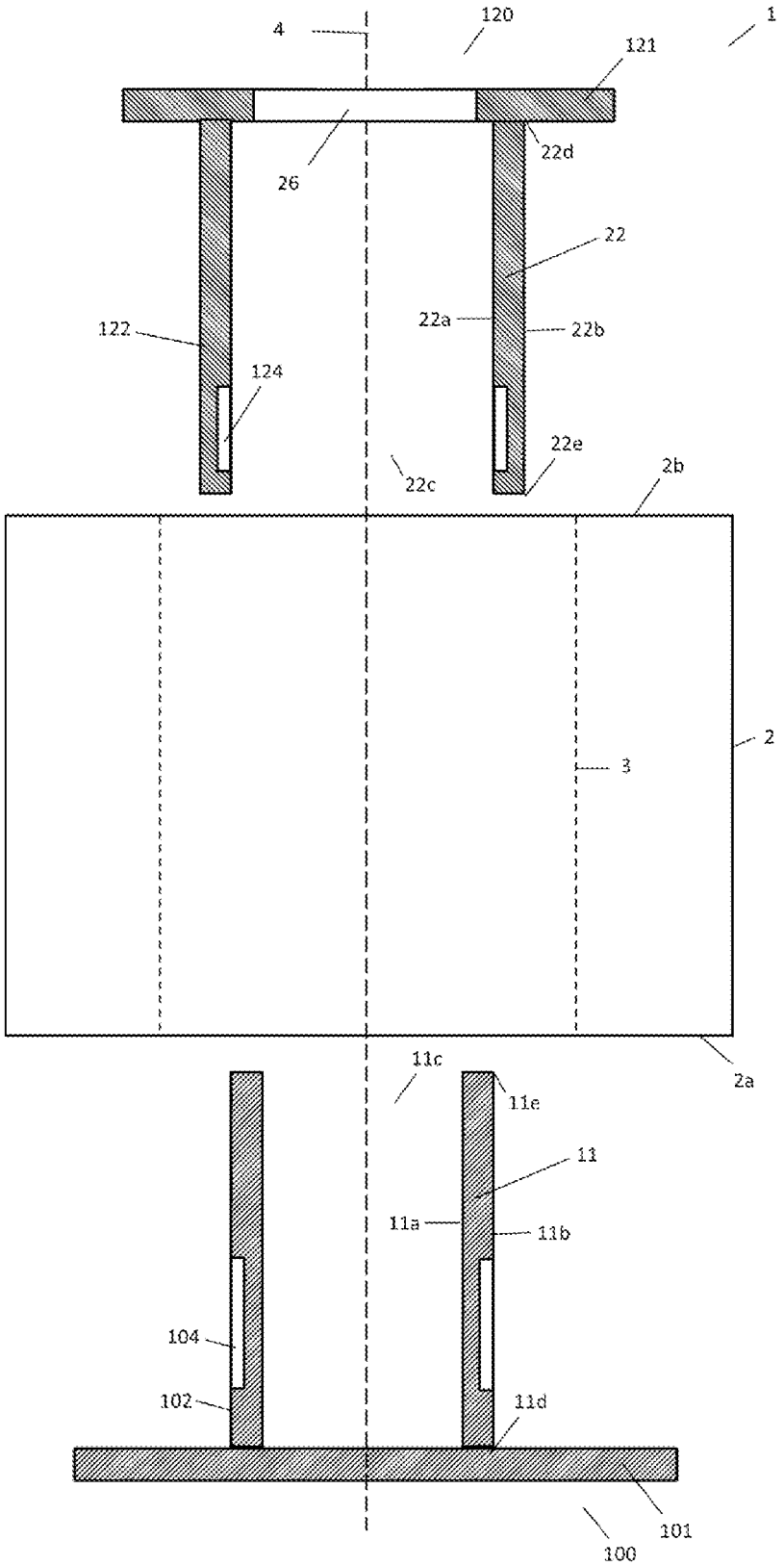
FIG. 1B shows a schematic exploded view of the connection assembly of FIG. 1A disassembled from the slab according to various embodiments.

FIG. 1A shows a schematic view of a connection assembly 1 assembled to a slab 2 according to various embodiments. FIG. 1B shows a schematic exploded view of the connection assembly 1 of FIG. 1A disassembled from the slab 2 according to various embodiments.

According to various embodiments, the connection assembly 1 may be provided. The connection assembly 1 may include a first connection part 100 and a second connection part 120 which may be connected to each other and assembled to the slab 2. According to various embodiments, when the connection assembly 1 is assembled to the slab 2, as shown in FIG. 1A, a bolt (see for example bolt 9 in FIG. 2D) may be connected to the slab 2 via connecting the bolt to the connection assembly 1.

According to various embodiments, the first connection part 100 of the connection assembly 1 may include a first clamping member 101. According to various embodiments, the first connection part 100 may include a first hollow-tubular-connecting-structure 102 extending from the first clamping member 101 (in a "first direction"). According to various embodiments, the first clamping member 101 may be adapted or configured to engage an exterior surface (e.g. a first surface 2*a*) of the slab 2, when the first hollow-tubular-connecting-structure 102 of the first connection part 100 is inserted into a through-hole 3 (or "connection-through-hole") of the slab 2. According to various embodiments, when the first hollow-tubular-connecting-structure 102 of the first connection part 100 is inserted into the through-hole 3 (i.e. connection-through-hole) of the slab 2 such that the first clamping member 101 engages or abuts the exterior surface (e.g. first surface 2*a*) of the slab 2, the first clamping member 101 may serve as a stopper or a barrier to prevent further insertion of the first connection part 100 into the through-hole 3 of the slab 2. According to various embodiments, the first clamping member 101 may be a plate (e.g. square, circular etc. plate), a cuboid, a sphere, a cylinder, a cone (e.g. inverted cone), a pyramid, a prism or any other suitably-shaped member configured or adapted to engage the exterior surface 2*a* of the slab 2 when the first hollow-tubular-connecting-structure 102 of the first connection part 100 is inserted into the through-hole 3 (or "connection-through-hole") in the slab 2.

According to various embodiments, with reference to FIG. 1B, the first hollow-tubular-connecting-structure 102 may be a tube having a cylindrical wall 11. The cylindrical wall 11 of the tube may have an interior cylindrical wall surface 11*a* and an exterior cylindrical wall surface 11*b*. The interior cylindrical wall surface 11*a* may define a through-hole 11*c* or an inner cavity of the first hollow-tubular-connecting-structure 102 that extends between a proximal end 11*d* and a distal end 11*e* of the first hollow-tubular-connecting-structure 102. The proximal end 11*d* of the first hollow-tubular-connecting-structure 102 may be an end of the first hollow-tubular-connecting-structure 102 which is a root of the first hollow-tubular-connecting-structure 102 or a transition between the first clamping member 101 and the first hollow-tubular-connecting-structure 102. The distal end 11*e* of the first hollow-tubular-connecting-structure 102 may be another end of the first hollow-tubular-connecting-structure 102 that is opposite the proximal end 11*d*. The distal end 11*e* of the first hollow-tubular-connecting-structure 102 may be a free-end thereof.

According to various embodiments, the interior cylindrical wall surface 11*a* of the first hollow-tubular-connecting-structure 102 may be configured for engagement with a bolt (e.g. threaded bolt). Accordingly, the interior cylindrical wall surface 11*a* of the first hollow-tubular-connecting-structure 102 may be a threaded interior wall surface (e.g. having right-handed threads).

According to various embodiments, the exterior cylindrical wall surface 11*b* of the first hollow-tubular-connecting-structure 102 may include a first engagement element 104. According to various embodiments, the first engagement element 104 may include exterior screw threads (e.g. right-handed threads), a magnetic coupling member, a ball or a socket of a ball-and-socket joint, a male or a female part of a bayonet coupling, or any other suitable coupling element or member that is adapted or configured to couple to a corresponding coupling element or member of the second connection part 120 of the connection assembly 1 to form a connection (e.g. joint) that detachably connects (or secures) the first connection part 100 and the second connection part 120 together.

According to various embodiments, the exterior cylindrical wall surface 11*b* (or exterior wall surface) of the first hollow-tubular-connecting-structure 102 may include only or consist of the first engagement element 104. According to various embodiments, when the exterior cylindrical wall surface (or exterior wall surface) 11*b* of the first hollow-tubular-connecting-structure 102 include only or consist of the first engagement element 104 on the exterior cylindrical wall surface 11*b*, the first engagement element 104 may partially or entirely cover (or may be positioned partially or entirely over) the exterior cylindrical wall surface 11*b* of the first hollow-tubular-connecting-structure 102.

According to various embodiments, the first hollow-tubular-connecting-structure 102 and the first clamping member 101 may be separate pieces joined together to form the first connection part 100 as a single unit. According to various embodiments, the first hollow-tubular-connecting-structure 102 may be attached or joined or coupled or secured to the first clamping member 101 by any suitable attachment or joint or coupling or fixture, for example, by a welding joint (e.g. full welding joint) between the first hollow-tubular-connecting-structure 102 and the first clamping member 101. Accordingly, the first hollow-tubular-connecting-structure 102 may extend from the first clamping member 101 via a welding joint (e.g. full welding joint).

According to various embodiments, the first hollow-tubular-connecting-structure 102 and the first clamping member 101 may be integrally formed into the first connection part 100 as a single integral structure (e.g. monolithic structure). For example, the first connection part 100 may be integrally casted or integrally molded with the first hollow-tubular-connecting-structure 102 and the first clamping member 101. The first connection part 100 may also be machined from a single block of material.

According to various embodiments, both the first hollow-tubular-connecting-structure 102 and the first clamping member 101 may comprise the same material, for example, a metal, an alloy (e.g. steel), carbon fibre or any other suitable material.

According to various embodiments, the first hollow-tubular-connecting-structure 102 may comprise a different material from the first clamping member 101.

According to various embodiments, the second connection part 120 of the connection assembly 1 may include a second clamping member 121. According to various embodiments, the second connection part 120 may include a second hollow-tubular-connecting-structure 122 extending from the second clamping member 121. According to various embodiments, the second clamping member 121 may be adapted or configured to engage an exterior surface of the slab 2 (e.g. a second surface 2*b* opposite the first surface 2*a*), when the second hollow-tubular-connecting-structure 122 of the second connection part 120 is inserted into the through-hole 3 in the slab 2. According to various embodiments, when the second hollow-tubular-connecting-structure 122 of the second connection part 120 is inserted into the through-hole 3 of the slab 2 in a manner such that the second clamping member 121 engages the exterior surface (e.g. a second surface 2*b*) of the slab 2, the second clamping 121 member may serve as a stopper or a barrier to prevent further insertion of the second connection part 120 into the through-hole 3 of the slab 2. According to various embodiments, the second clamping member 121 may be a plate (e.g. square, circular etc. plate), a cuboid, a sphere, a cylinder, a cone (e.g. inverted cone), a pyramid, a prism or any other suitably-shaped member configured or adapted to engage the exterior surface 2*b* of the slab 2, when the second hollow-tubular-connecting-structure 122 of the second connection part 120 is inserted into the through-hole 3 (i.e. connection-through-hole) in the slab 2.

According to various embodiments, the second hollow-tubular-connecting-structure 122 may be a tube having a cylindrical wall 22. The cylindrical wall 22 of the tube may have an interior cylindrical wall surface 22*a* and an exterior cylindrical wall surface 22*b*. The interior cylindrical wall surface 22*a* may define a through-hole 22*c* or an inner cavity of the second hollow-tubular-connecting-structure 122 that extends between a proximal end 22*d* and a distal end 22*e* of the second hollow-tubular-connecting-structure 122. The proximal end 22*d* of the second hollow-tubular-connecting-structure 122 may be an end of the second hollow-tubular-connecting-structure 122 which is a root of the second hollow-tubular-connecting-structure 122 or a transition between the second clamping member 121 and the second hollow-tubular-connecting-structure 122. The distal end 22*e* of the second hollow-tubular-connecting-structure 122 may be another end of the second hollow-tubular-connecting-structure 122 that is opposite the proximal end 22*d*. The distal end 22*e* of the second hollow-tubular-connecting-structure 122 may be a free-end thereof.

According to various embodiments, the interior cylindrical wall surface 22*a* of the second hollow-tubular-connecting-structure 122 may include a second engagement element 124. According to various embodiments, the second engagement element 124 may include interior screw threads (e.g. right-handed threads for mating with the right-handed threads of the corresponding first engagement element 104 of the first hollow-tubular-connecting-structure 102), a magnetic coupling member, a ball or a socket of a ball-and-socket joint, a male or a female part of a bayonet coupling, or any other suitable coupling element or member that is adapted or configured to couple to a corresponding coupling element or member of the first connection part 100 of the connection assembly 1 to form the connection (e.g. joint) that detachably connects (or secures) the second connection part 120 and the first connection part 100 together.

According to various embodiments, the exterior cylindrical wall surface 22*b* (or exterior wall surface), in particular, the entire exterior cylindrical wall surface 22*b*, of the second hollow-tubular-connecting-structure 122 may include a smooth (in other words, not uneven) cylindrical surface that is free from (or without) any protrusion(s) (e.g. protruding member(s) or protruding element(s)) and/or any recess(es) (e.g. groove(s) or indent(s)) and/or any attachment/coupling member.

According to various embodiments, the second hollow-tubular-connecting-structure 122 and the second clamping member 121 may be separate pieces joined together to form the second connection part 120 as a single unit. According to various embodiments, the second hollow-tubular-connecting-structure 122 may be attached (or joined or coupled or secured) to the second clamping member 121 by any suitable attachment (or joint or coupling or fixture), for example, by a welding joint between the second hollow-tubular-connecting-structure 122 and the second clamping member 121. Accordingly, the second hollow-tubular-connecting-structure 122 may extend from the second clamping member 121 via a welding joint (e.g. full welding joint).

According to various embodiments, the second hollow-tubular-connecting-structure 122 and the second clamping member 121 may be a single integral structure (e.g. monolithic structure). For example, the second connection part 120 may be integrally casted or integrally molded with the second hollow-tubular-connecting-structure 122 and the second clamping member 121. The second connection part 120 may also be machined from a single block of material.

According to various embodiments, both the second hollow-tubular-connecting-structure 122 and the second clamping member 121 may comprise the same material, for example, a metal, an alloy (e.g. steel), carbon fibre or any other suitable material.

According to various embodiments, the second hollow-tubular-connecting-structure 122 may comprise a different material from the second clamping member 121.

According to various embodiments, the second clamping member 121 of the second connection part 120 may include an opening 26 (e.g. through-hole) providing access (e.g. for a bolt to pass or be inserted through) to the inner cavity 22*c* (e.g. through-hole) of the second hollow-tubular-connecting-structure 122 of the second connection part 120. According to various embodiments, the opening 26 of the second clamping member 121 may have a minimum width (or diameter) equal or larger than an inner diameter (e.g. cross-sectional inner diameter) of the first hollow-tubular-connecting-structure 102. The minimum width of the opening of the second clamping member 121 may be defined as the closest (or shortest) perpendicular distance between two opposite edges (or points) on the rim of the opening 26, According to various embodiments, the connection assembly 1 may be assembled by inserting the first hollow-tubular-connecting-structure 102 into the second hollow-tubular-connecting-structure 122 to connect the first connection part 100 and the connection part 120 to each other (or together).

According to various embodiments, an inner diameter of the second hollow-tubular-connecting-structure 122 may be equal or larger than an outer diameter of the first hollow-tubular-connecting-structure 102 such that the first hollow-tubular-connecting-structure 102 may be inserted into the second hollow-tubular-connecting-structure 122 to engage the first engagement element 104 with the second engagement element 124 so as to form the connection or joint or coupling that connects or secures or detachably secures the first connection part 100 and the second connection part 120 to each other.

In detail, to insert the first hollow-tubular-connecting-structure 102 of the first connection 100 part into the second hollow-tubular-connecting-structure 122 of the second connection part 120, the first hollow-tubular-connecting-structure 102 and the second hollow-tubular-connecting-structure 122 may be aligned along an axis 4 ("connection axis" of the connection), such that the longitudinal axis of the first hollow-tubular-connecting-structure 102 and the longitudinal axis of the second hollow-tubular-connecting-structure 122 lie or are positioned entirely along and are parallel to the connection axis 4 (in other words, the first hollow-tubular-connecting-structure 102 and the second hollow-tubular-connecting-structure 122 are coaxial, such that they share the same axis 4, i.e. the connection axis 4). According to various embodiments, the first hollow-tubular-connecting-structure 102 and the second hollow-tubular-connecting-structure 122 may be directed towards each other in a manner such that the distal end 11*e* of the first hollow-tubular-connecting-structure 102 is directed towards or faces the distal end 22*e* of the second hollow-tubular-connecting-structure 122. In other words, the distal ends 11*e*, 22*e*, of the first hollow-tubular-connecting-structure 102 and the second hollow-tubular-connecting-structure 122 may be respectively directed towards or facing each other. With the first hollow-tubular-connecting-structure 102 of the first connection part 100 and the second hollow-tubular-connecting-structure 122 of the second connection part 120 aligned along the connection axis 4 and directed towards each other, the first hollow-tubular-connecting-structure 102 of the first connection part 100 may be inserted into the second hollow-tubular-connecting-structure 122 of the second connection part 120. With the first hollow-tubular-connecting-structure 102 inserted into the second hollow-tubular-connecting-structure 122, the first engagement element 104 of the first hollow-tubular-connecting-structure 102 may engage with the second engagement element 124 of the second hollow-tubular-connecting-structure 122 to form the connection between the first connection part 100 and the second connection part 120 to thereby form the assembled (or complete assembly of the) connection assembly 1.

Accordingly, according to various embodiments, the first connection part 100 and the second connection part 120 may be connectable to each other with the first hollow-tubular-connecting-structure 102 of the first connection part 100 and the second hollow-tubular-connecting-structure 122 of the second connection part 120 aligned along the connection axis 4 and directed towards each other such that the first hollow-tubular-connecting-structure 102 is insertable into the second hollow-tubular-connecting-structure 122 to form the connection along the connection axis 4 with the first engagement element 104 of the exterior wall surface (i.e. exterior cylindrical wall surface 11*b*) of the first hollow-tubular-connecting-structure 102 and the second engagement element 124 of the interior wall surface (i.e. interior cylindrical wall surface 22*a*) of the second engagement element 124 engaged (i.e. detachably connected or secured) to each other.

According to various embodiments, the connection assembly 1 may be capable of being retrofitted or assembled to the slab 2 (e.g. precast slab, concrete slabs, stone slabs etc.) having at least the through-hole (i.e. connection-through-hole 3) which extends between two opposite surfaces 2*a*, 2*b* (or sides) of the slab 2. In other words, the first connection part 100 and the second connection part 120 of the connection assembly 1, according to various embodiments, are capable of being assembled to the slab 2 having at least the through-hole (i.e. connection-through-hole 3) which extends between two opposite surfaces 2*a*, 2*b* of the slab. As an example, as shown in FIG. 1A, the first connection part 100 and the second connection part 120 of the connection assembly 1, according to various embodiments, may be assembled to the slab 2 in a manner so as to sandwich or clamp the slab 2, between the first clamping member 101 of the first connection part 100 of the connection assembly 1 and the second clamping member 121 of the second connection part 120 of the connection assembly 1 between the two opposite surfaces 2*a*, 2*b* of the slab 2, and with the connection axis 4 (i.e. of the connection between the first hollow-tubular-connecting-structure 102 and the second hollow-tubular-connecting-structure 122) extending through the through-hole 3 (i.e. connection-through-hole 3) in the slab 2. According to various embodiments, when the connection assembly 1 is retrofitted to the slab 2 (or when the first connection part 100 and the second connection part 120 of the connection assembly 1 are assembled to the slab 2), the connection formed between the first hollow-tubular-connecting-structure 102 and the second hollow-tubular-connecting-structure 122 may lie or be positioned or located within the through-hole 3 (i.e. connection-through-hole 3) of the slab 1.

According to various embodiments, a combination of the first hollow-tubular-connecting-structure 102, the first engagement element 104, the second hollow-tubular-connecting-structure 122 and the second engagement element 124 may serve as an "adjustment system" configured or adapted to adjust or vary a perpendicular distance or length of a space between the first clamping member 101 and the second clamping member 121 for receiving and sandwiching slabs 2 of different sizes or thicknesses therebetween the first clamping member 101 and the second clamping member 121. For example, according to various embodiments, the first hollow-tubular-connecting-structure 102 may be fully or partially inserted into the second hollow-tubular-connecting-structure 122. When the first hollow-tubular-connecting-structure 102 is fully inserted into the second hollow-tubular-connecting-structure 122, the distance or length and, in turn, the perpendicular distance or length between the first clamping member 101 and the second clamping member 121 may be smaller as compared to the perpendicular distance or length between the first clamping member 101 and the second clamping member 121 when the first hollow-tubular-connecting-structure 102 is partially inserted into the second hollow-tubular-connecting-structure 122. Conversely, when the first hollow-tubular-connecting-structure 102 is partially inserted into the second hollow-tubular-connecting-structure 122, the perpendicular distance or length of the space between the first clamping member 101 and the second clamping member 121 may be larger as compared to the perpendicular distance or length of the space between the first clamping member 101 and the second clamping member 121 when the first hollow-tubular-connecting-structure 102 is fully inserted into the second hollow-tubular-connecting-structure 122.

Figure 2A:
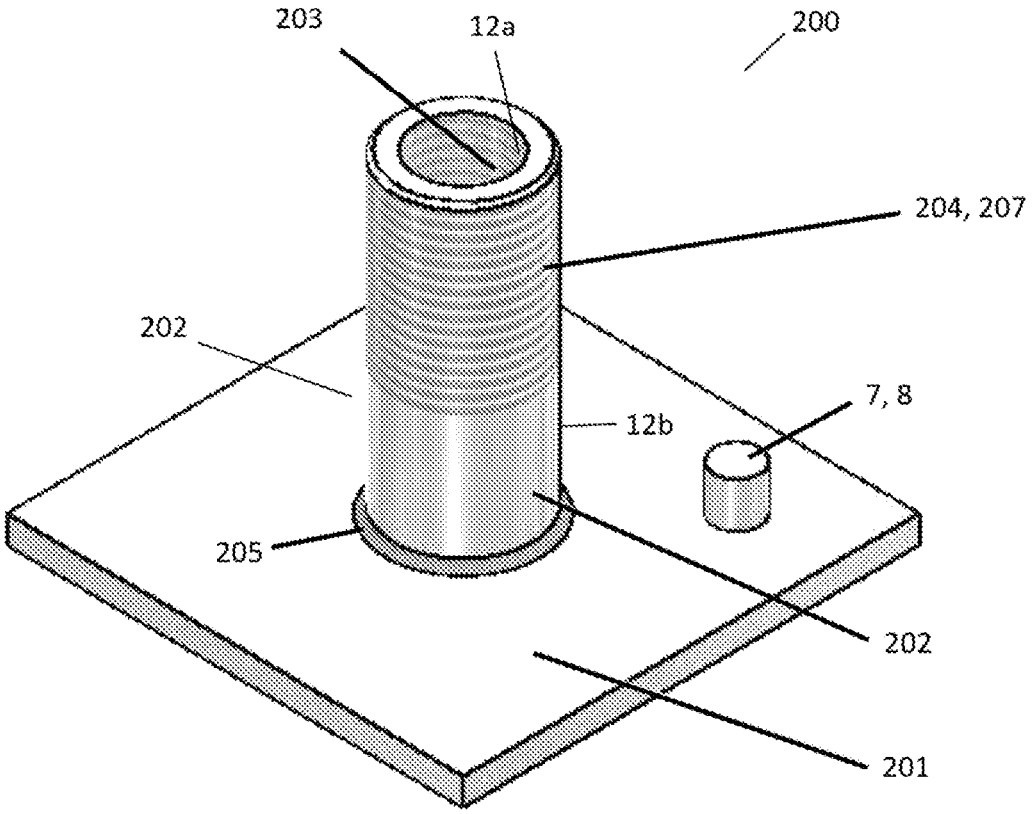
FIG. 2A shows a perspective view of a first connection part having an anti-rotation element according to various embodiments.
Figure 2B:
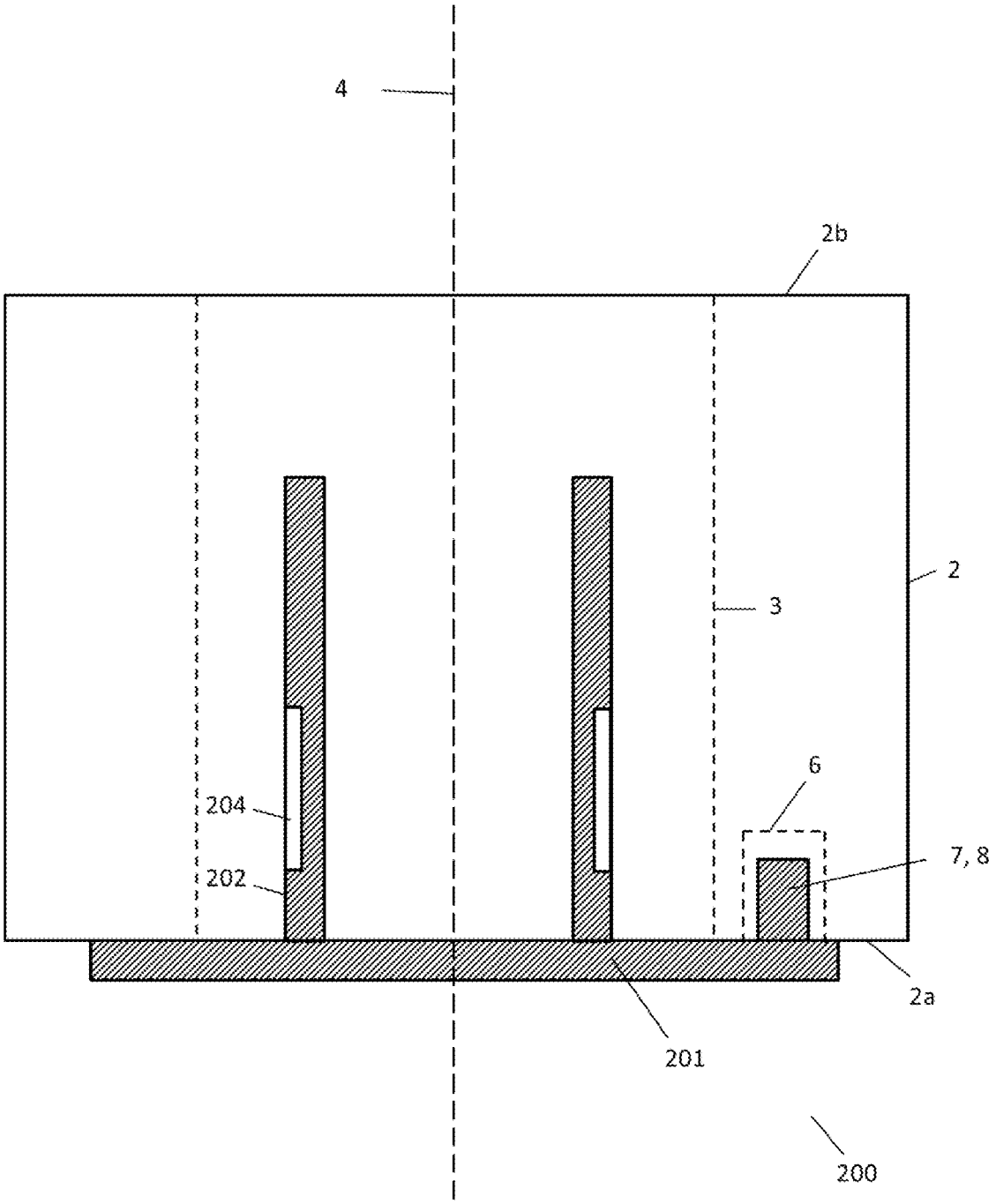
FIG. 2B shows a schematic cross-section view of the first connection part of FIG. 2A engaged with the slab according to various embodiments.
Figure 2C:
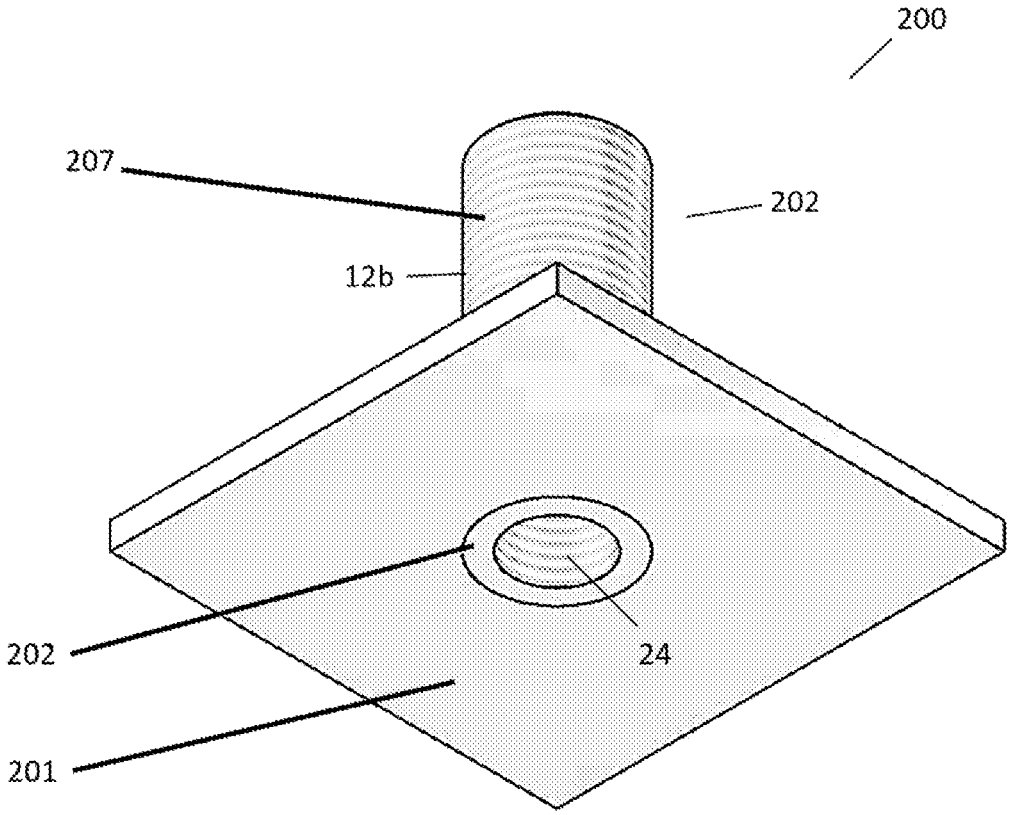
FIG. 2C shows the first connection part of FIG. 2A with a first clamping member having an opening according to various embodiments.
Figure 2D:
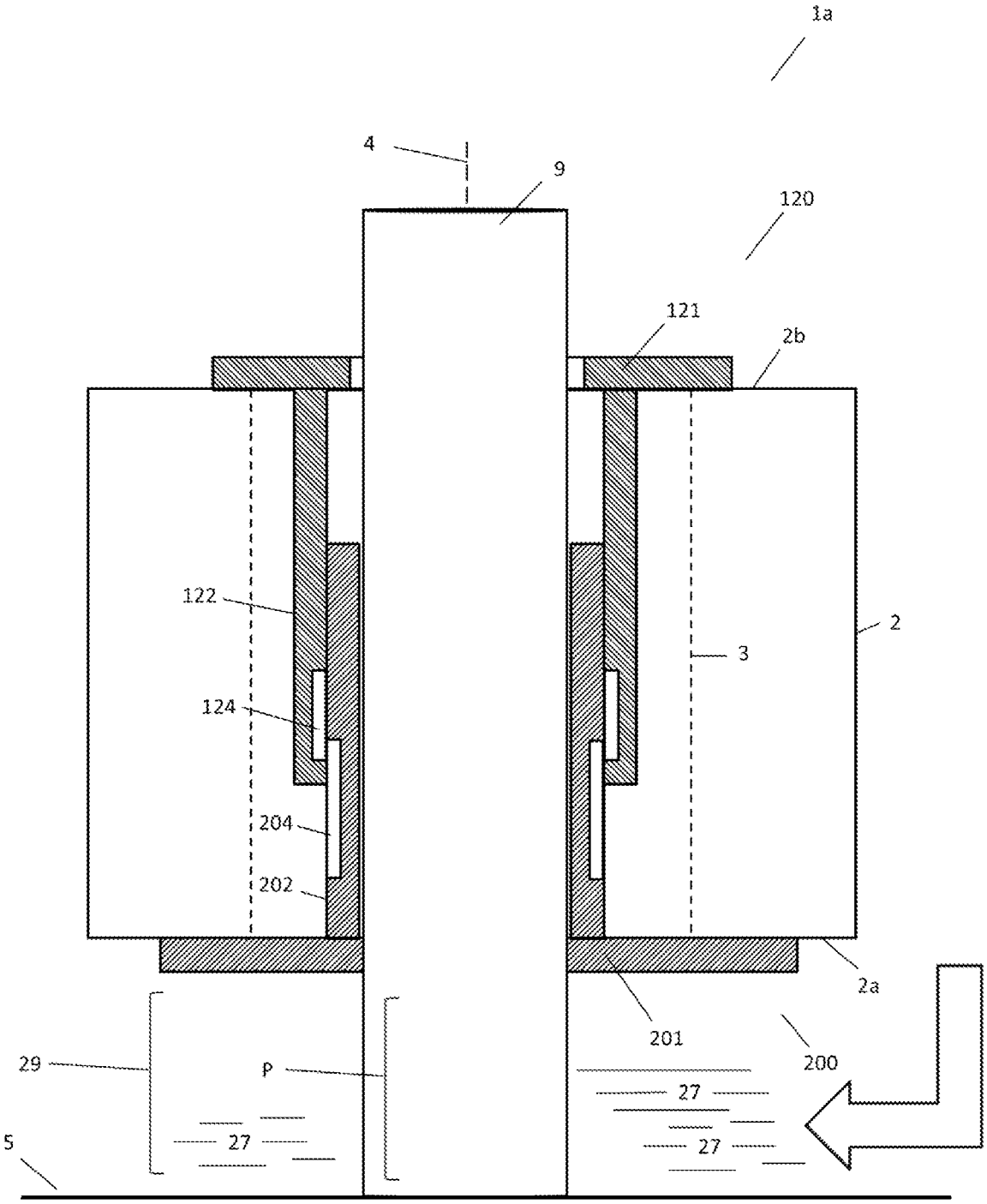
FIG. 2D shows a connection assembly including the first connection part of FIG. 2A and the second connection part of FIG. 1A along with a bolt inserted therethrough according to various embodiments.
Figure 3A:
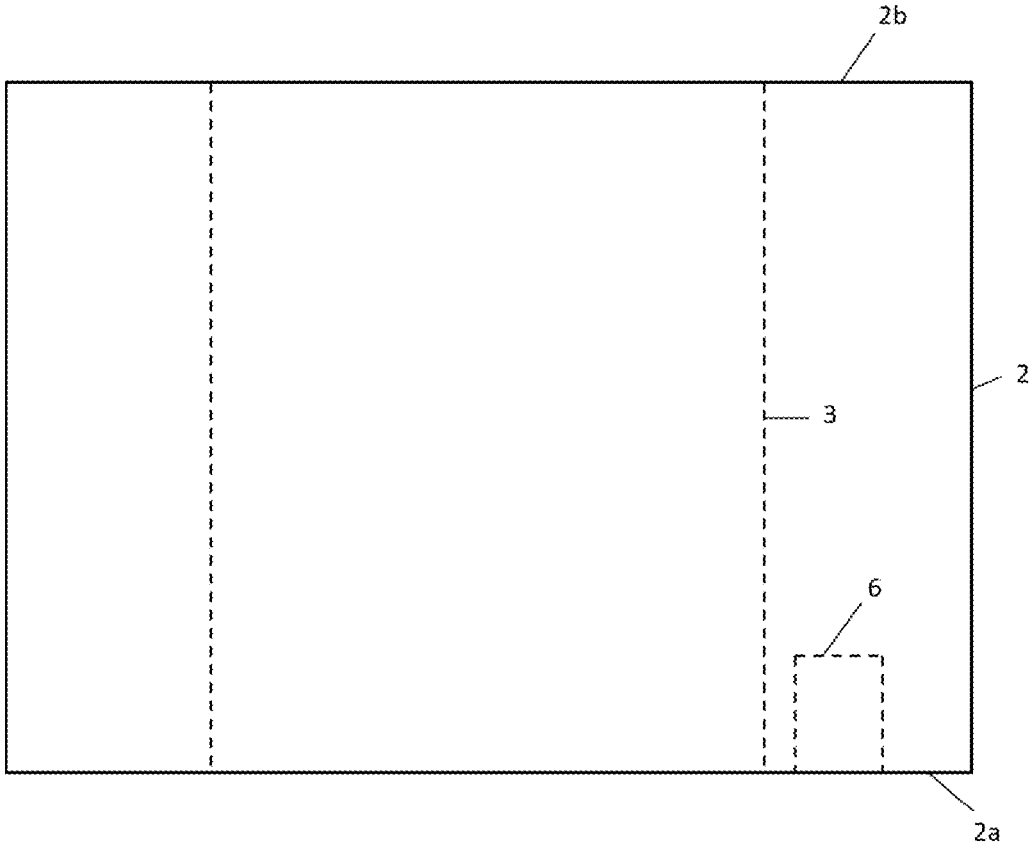
FIG. 3A shows a schematic view of a slab of a levelling or lifting system according to various embodiments.
Figure 3B:
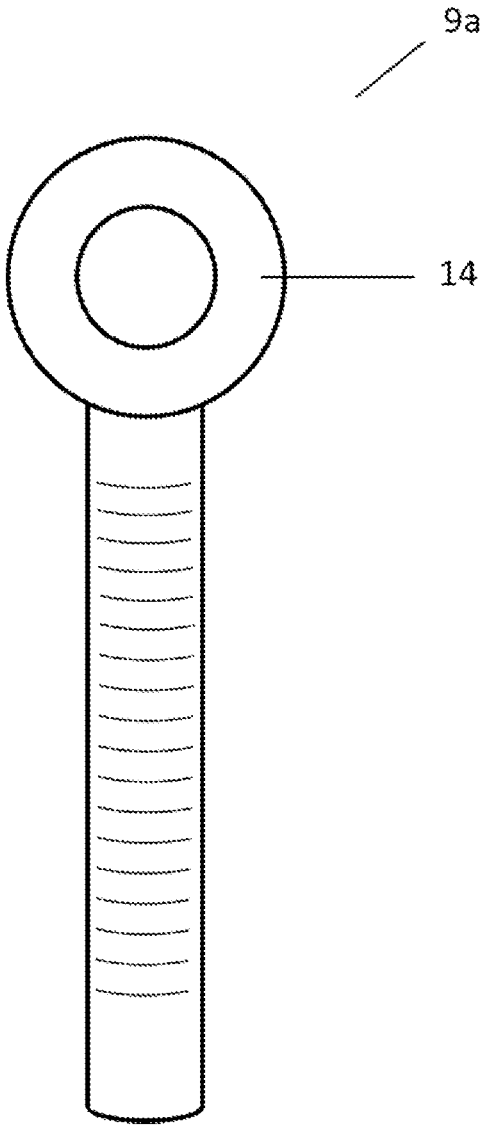
FIG. 3B shows a perspective view of a lifting bolt of a levelling or lifting system according to various embodiments.
Figure 3C:
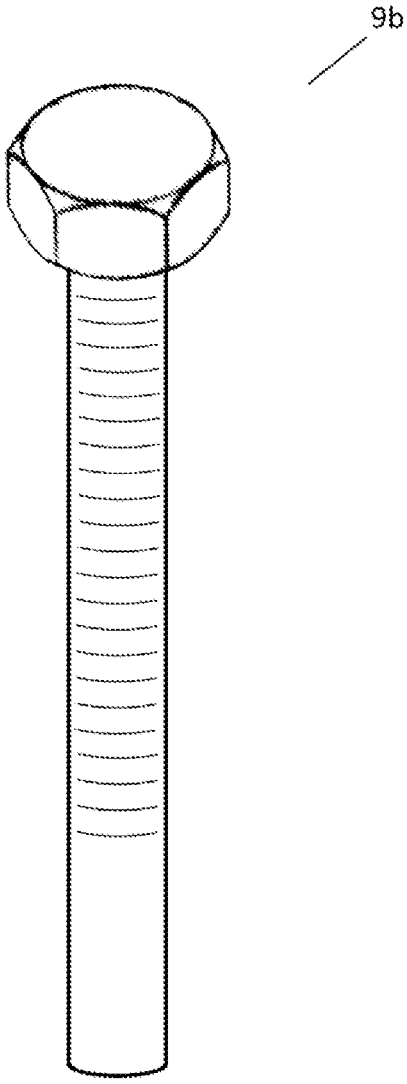
FIG. 3C shows a perspective view of a levelling bolt of a levelling or lifting system according to various embodiments.

According to various embodiments, when the connection assembly 1 is retrofitted to the slab 2 (or when the first connection part 100 and the second connection part 120 of the connection assembly 1 is assembled to the slab 2), a bolt (e.g. lifting or a levelling bolt, see for example FIG. 2D, FIG. 3B and FIG. 3C, may be connectable (e.g. threadedly engaged) to the 'slab 2 with the connection assembly 1' (i.e. connection assembly 1 already retrofitted to the slab 2) by screwing the bolt (e.g. lifting bolt or levelling bolt) into the first hollow-tubular-connecting-structure 102 of the first connection part 100 of the connection assembly 1 for threaded engagement with the threaded interior wall surface of the first hollow-tubular-connecting-structure 102 through the opening 26 (e.g. a polygonal-shaped opening or a hexagonal-shaped opening) of the second clamping member 121 of the second connection part 120 of the connection assembly 1. The bolt (e.g. lifting bolt and/or levelling bolt), when connected (e.g. threadedly engaged) to the slab 2 with the connection assembly 1, may then be used to lift or level the slab 2.

FIGS. 2A to 2C show a first connection part 200 according to various embodiments. According to various embodiments, the first connection part 200 of FIG. 2A to FIG. 2C may be similar or identical to the first connection part 100 of FIG. 1A and FIG. 1B.

According to various embodiments, the first connection part 200 may, likewise to the first connection part 100 of FIG. 1A and FIG. 1B, include a first clamping member 201. As shown in FIG. 2A, according to various embodiments, the first clamping member 201 may be a square plate 201 (or first plate 201).

According to various embodiments, the first connection part 200 may, likewise to the first connection part 100 of FIG. 1A and FIG. 1B, include a first hollow-tubular-connecting-structure 202. As shown in FIG. 2A, according to various embodiments, the first hollow-tubular-connecting-structure 202 may extend substantially perpendicularly from the first plate 201. According to various embodiments, the first hollow-tubular-connecting-structure 202 may extend substantially perpendicularly from a planar surface of the first plate 201 such that a longitudinal axis of the first hollow-tubular-connecting-structure 202 is substantially perpendicular the planar surface of the first plate 201.

According to various embodiments, the first hollow-tubular-connecting-structure 202 and the first plate 201 may be separate pieces joined together to form the first connection part 200 as a single unit.

According to various embodiments, the first hollow-tubular-connecting-structure 202 and the first plate 201 respectively comprises steel.

According to various embodiments, the first hollow-tubular-connecting-structure 202 may be attached or joined or coupled or secured to the first clamping member 201 by a first welding joint 205 (e.g. full welding joint) between the first hollow-tubular-connecting-structure 202 and the first clamping member 201. Accordingly, the first hollow-tubular-connecting-structure 202 may extend from the first clamping member 201 via the first welding joint 205 (e.g. full welding joint). According to various embodiments, the first welding joint 205 between the first hollow-tubular-connecting-structure 202 and the first clamping member 201 may provide or create a strong connection between the first hollow-tubular-connecting-structure 202 and the first clamping member 201. According to various embodiments, the first welding joint 205 may be configured or adapted to withstand at least 50 Kilo Newton (kN) of force without breaking (in other words, decoupling/separating the first hollow-tubular-connecting-structure 202 from the first clamping member 201).

According to various embodiments, the first hollow-tubular-connecting-structure 202 may, likewise to the first connection part 100 of FIG. 1A and FIG. 1B, be a tube having interior cylindrical wall surface 12*a* and exterior cylindrical wall surface 12*b*.

As shown in FIG. 2A, according to various embodiments, the interior cylindrical wall surface 12*a* of the first hollow-tubular-connecting-structure 202 may be a threaded interior wall surface 203 (e.g. having right-handed threads).

According to various embodiments, the exterior cylindrical wall surface 12*b* of the first hollow-tubular-connecting-structure 202 may, likewise to the first connection part 100 of FIG. 1A and FIG. 1B, have a first engagement element 204. As shown, according to various embodiments, the first engagement element 204 may include exterior screw threads 207 (e.g. right-handed threads). According to various embodiments, the exterior cylindrical wall surface 12*b* (or exterior wall surface) of the first hollow-tubular-connecting-structure 202 may include only or consist of screw threads 207 on the exterior cylindrical wall surface 12*b*. According to various embodiments, when the exterior cylindrical wall surface 12*b* (or exterior wall surface) of the first hollow-tubular-connecting-structure 202 include only or consist of screw threads 207, the screw threads 207 may partially or entirely cover (or may be positioned partially or entirely over) the exterior cylindrical wall surface 12*b* of the first hollow-tubular-connecting-structure 202.

FIG. 2A shows a perspective view of the first connection part 200 having an anti-rotation element 7 according to various embodiments. FIG. 2B shows a schematic cross-section view of the first connection 200 part of FIG. 2A engaged with the slab 2 according to various embodiments.

According to various embodiments, the first connection part 200 of FIG. 2A to FIG. 2C may differ from the first connection part 100 of FIG. 1A and FIG. 1B in that the first connection part 200 of FIG. 2A to FIG. 2C may include the following additional features. According to various embodiments, the first clamping member 201 of the first connection part 200 may further include the anti-rotation element 7 configured or adapted to impede a rotation of the first connection part 200 about the longitudinal axis of the first hollow-tubular-connecting-structure 202 when the anti-rotation element 7 is engaged (e.g. inserted) with the slab 2. For example, the anti-rotation element 7 may be inserted into a hole, i.e. anchoring hole 6 (see FIG. 2B), which may be a blind-hole or through-hole and/or shaped-hole and/or recess, in the slab 2. The anchoring hole 6 may be separate from the connection-through-hole 3. As shown in FIG. 2A and FIG. 2B, according to various embodiments, the anti-rotation element 7 may include a protruding structure 8. For example, the protruding structure 8 may be a cylindrical structure or any other suitably-shaped structure. According to various embodiments, the protruding structure 8 may extend from the first clamping member 201. According to various embodiments, the protruding structure 8 may protrude from the same surface of the first clamping member 201 from which the first hollow-tubular-connecting-structure 202 extends or protrudes. According to various embodiments, the protruding structure 8 may extend or protrude in the same extension direction (i.e. first direction) as the first hollow-tubular-connecting-structure 202 which extends from the first clamping member 201, and may be substantially parallel to the first hollow-tubular-connecting-structure 202. According to various embodiments, the anti-rotation element 7, for example in the form of the protruding structure 8, may be configured or adapted for insertion into the anchoring hole 6 to impede rotation of the first connection part 200. For example, the anti-rotation element 7 may be inserted or is insertable into the anchoring hole 6 as the first hollow-tubular-connecting-structure 202 is inserted into the connection-through-hole 3 such that the anti-rotation element 7 impedes a rotation (e.g. rotation motion) of the first connection part 200 with respect to the slab 2 about the connection axis 4.

Further, FIG. 2C shows a bottom perspective view of the first connection part 200 of FIG. 2A with the first clamping member 201 having an opening 24 according to various embodiments. FIG. 2D shows a bolt 9 inserted into a connection assembly 1*a*, formed by the first connection part 200 of FIG. 2A connected to the second connection part 120 of FIG. 1A, and with a bolt 9 inserted into the connection assembly 1*a* through the opening 26 of the second clamping member 121 and the inner cavity 22*c* of the second connection part 120, into and through an inner cavity of the first connection part 200 (similar or identical to the inner cavity 11*c* in FIG. 1B) so as to protrude from the opening 24 of the first connection part 200.

According to various embodiments, the bolt 9 may be provided. According to various embodiments, the first clamping member 201 may further include the opening 24 (e.g. through-hole) providing access (e.g. for the bolt 9 to pass through) to the inner cavity (e.g. through-hole) (similar or identical to the inner cavity 11*c* in FIG. 1B) of the first hollow-tubular-connecting-structure 202 of the first connection part 200. According to various embodiments, the bolt 9 (e.g. levelling bolt) may be screwed into the first hollow-tubular-connecting-structure 202 of the first connection part 200 through the opening 26 (see FIG. 1A) of the second clamping member 121 of the second connection part 120, such that the bolt 9 (e.g. levelling bolt) is capable of penetrating the first connection part 200 to protrude from the opening 24 of the first clamping member 201. The bolt 9 (e.g. levelling bolt), when protruding from the opening 24 of the first clamping member 201, may be used to level the slab 2 by urging the protruding portion P of the bolt 9 against an external surface 5 (e.g. underlying ground 5).

Figure 2E:
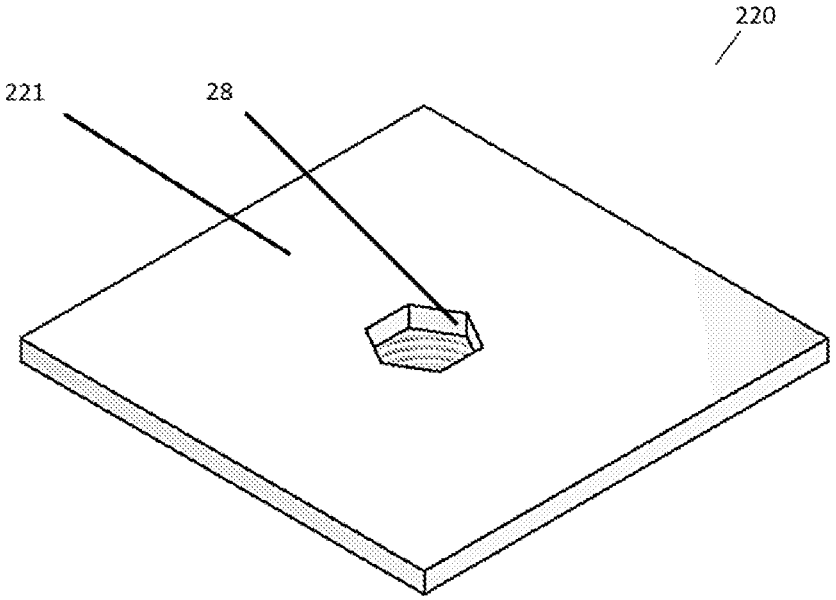
FIG. 2E shows a perspective view of a second connection part having a hexagonal-shaped opening in a second clamping member according to various embodiments.
Figure 2F:
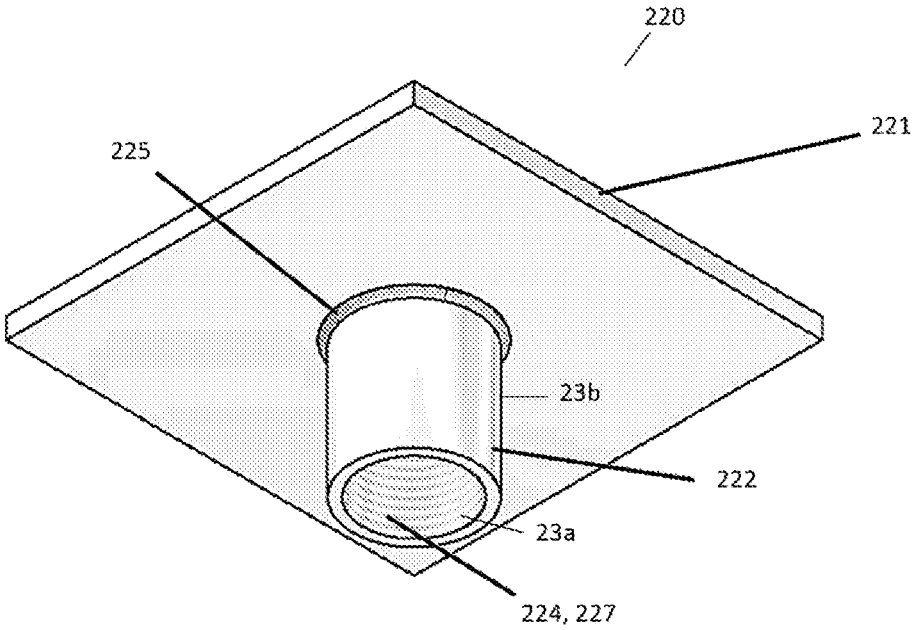
FIG. 2F shows a bottom perspective view of the second connection part of FIG. 2E according to various embodiments.

FIG. 2E and FIG. 2F show a second connection part 220 that may be similar or identical to the second connection part 120 of FIG. 1A and FIG. 1B according to various embodiments. According to various embodiments, the second connection part 220 may, likewise to the second connection part 120 of FIG. 1A and FIG. 1B, include a second clamping member 221. As shown in FIG. 2E and FIG. 2F, according to various embodiment, the second clamping member 221 may be a square plate 221 (e.g. second plate).

According to various embodiments, the second connection part 220 may, likewise to the second connection part 120 of FIG. 1A and FIG. 1B, include a second hollow-tubular-connecting-structure 222. As shown in FIG. 2E and FIG. 2F, according to various embodiments, the second hollow-tubular-connecting-structure 222 may extend substantially perpendicularly from the second plate 221. According to various embodiments, the second hollow-tubular-connecting-structure 222 may extend substantially perpendicularly from a planar surface of the second plate 221 such that a longitudinal axis of the second hollow-tubular-connecting-structure 222 is substantially perpendicular the planar surface of the second plate 221.

According to various embodiments, the second hollow-tubular-connecting-structure 222 and the second plate 221 may be separate pieces joined together to form the second connection part 220 as a single unit.

According to various embodiments, the second hollow-tubular-connecting-structure 222 and the second plate 221 respectively comprises steel.

According to various embodiments, the second hollow-tubular-connecting-structure 222 may be attached or joined or coupled or secured to the second clamping member 221 by a second welding joint 225 (e.g. full welding joint) between the second hollow-tubular-connecting-structure 222 and the second clamping member 221. Accordingly, the second hollow-tubular-connecting-structure 222 may extend from the second clamping member 221 via the second welding joint 225 (e.g. full welding joint). According to various embodiments, the second welding joint 225 between the second hollow-tubular-connecting-structure 222 and the second clamping member 221 may provide or create a strong connection between the second hollow-tubular-connecting-structure 222 and the second clamping member 221. According to various embodiments, the second welding joint 225 may be adapted to withstand at least 50 kN of force without breaking (in other words, decoupling/separating the second hollow-tubular-connecting-structure 222 from the second clamping member 221).

According to various embodiments, the second hollow-tubular-connecting-structure 222 may, likewise to the second connection part 120 of FIG. 1A and FIG. 1B, be a tube having interior and exterior cylindrical wall surfaces 23*a*, 23*b*.

According to various embodiments, the interior cylindrical wall surface 23*a* of the second hollow-tubular-connecting-structure 222 may, likewise to the second connection part 120 of FIG. 1A and FIG. 1B, have a second engagement element 224. As shown, according to various embodiments, the second engagement element 224 may include interior screw threads 227 (e.g. right-handed threads for mating with the right-handed threads of the corresponding first engagement element 204, 207).

According to various embodiments, second connection part 220 of FIG. 2E and FIG. 2F may differ from the second connection part 120 of FIG. 1A and FIG. 1B in that the second connection part 220 of FIG. 2E and FIG. 2F may include the following additional features. FIG. 2E shows a perspective view of the second connection part 220 having a hexagonal-shaped opening 28 according to various embodiments. FIG. 2F shows a bottom perspective view of the second connection part 220 of FIG. 2E according to various embodiments.

According to various embodiments, the second clamping member 221 may, likewise to the second clamping member 121 of the second connection part 120 of FIG. 1A and FIG. 1B, include an opening 28. As shown, according to various embodiments, the opening 28 of the second clamping member 221 may be a polygonal-shaped opening, for example, a regular polygonal-shaped or an irregular polygonal-shaped opening. As shown in FIG. 2E, according to various embodiments, the opening 28 of the second clamping member 221 (e.g. second plate 221) is a hexagonal-shaped opening 28. According to various embodiments, the hexagonal-shaped opening 28 may be positioned in the middle of the second plate 221 (e.g. central of the planar surface of the second plate 221). According to various embodiments, the opening 28 may have a minimum width (e.g. lateral width) equal or larger than an inner diameter (e.g. cross-sectional inner diameter) of the first hollow-tubular-connecting-structure 202.

According to various embodiments, the opening 28 may be further configured or adapted to receive a key (e.g. a polygonal-shaped key, such as a hex key) for rotating the second connection part 220 about the longitudinal axis of the second hollow-tubular-connecting-structure 222 via the key to loosen or tighten the second connection part 220 with respect to the first connection part 200. According to various embodiments, the key may be inserted into the opening 28 and rotated so as to rotate the second connection part 220 relative to the first connection part 200.

Figure 2G:
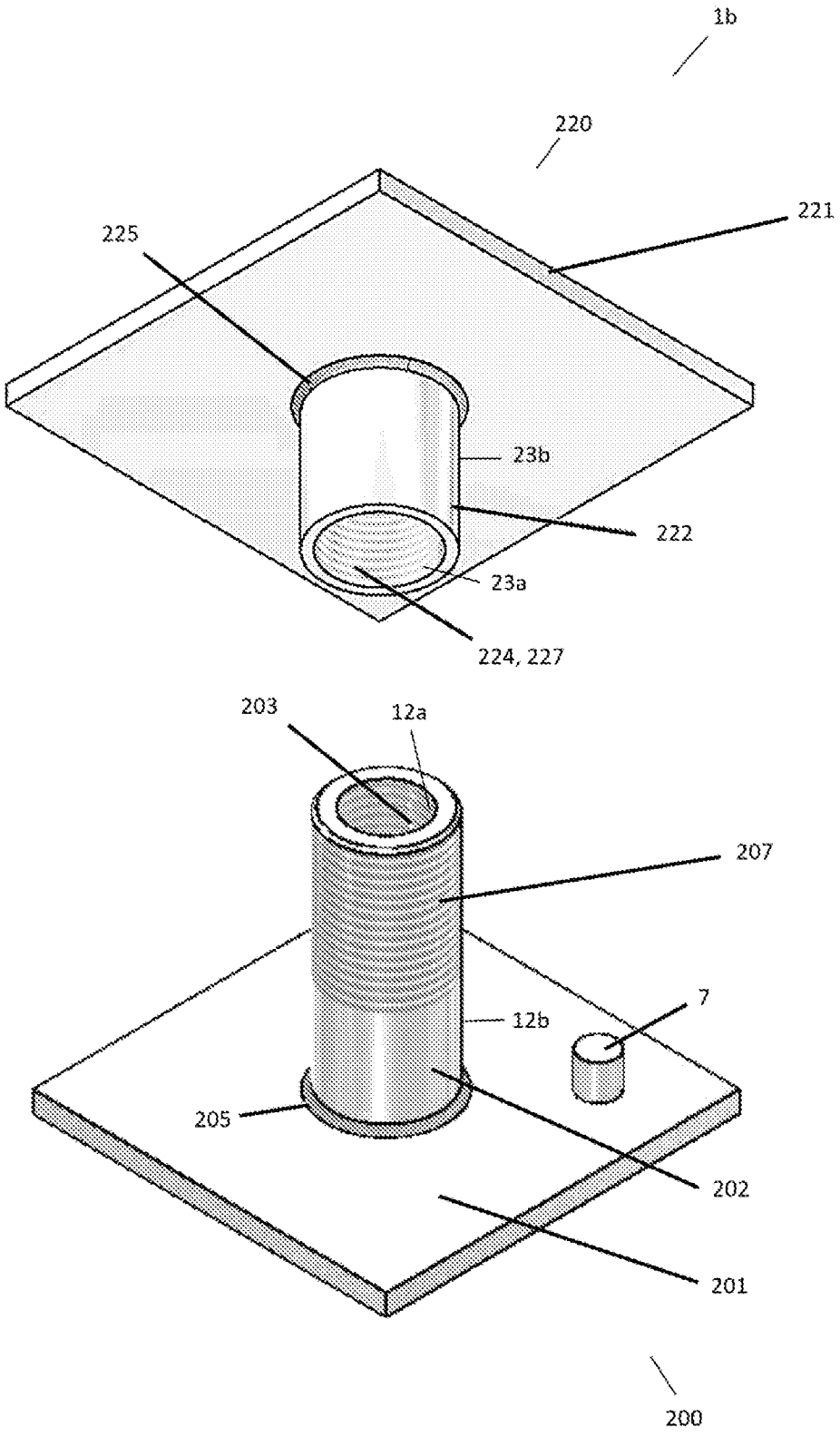
FIG. 2G shows a connection assembly including the first connection part of FIG. 2A and the second connection part of FIG. 2F in a disassembled state according to various embodiments.

FIG. 2G shows a connection assembly 1*b* including the first connection part 200 of FIG. 2A and the second connection part 220 of FIG. 2F in a disassembled state according to various embodiments. According to various embodiments, the connection assembly 1*b* may include the first connection part 200 of FIG. 2A to FIG. 2C and the second connection part 220 of FIG. 2E and FIG. 2F. Accordingly, according to various embodiments, the first connection part 200 of the connection assembly 1*b* may include the first plate 201 (e.g. square base plate), the first hollow-tubular-connecting-structure 202 (e.g. tube) with exterior or external screw threads 207 for connecting the first connection part 200 to the second connection part 220, the interior or internal screw threads 203 (e.g. according to a specification of a levelling bolt or a lifting bolt), the anti-rotation member 7 (e.g. cylindrical structure) to prevent the first connection part 200 from rotating during assembly of the connection assembly 1*b* (e.g. to a slab), and the first welding joint 205 (e.g. full welding joint) to create a strong connection between the first hollow-tubular-connecting-structure 202 and the first plate 201.

According to various embodiments, the second connection part 220 of the connection assembly 1*b* may include the second plate 221 (e.g. square base plate), the second hollow-tubular-connecting-structure 222 (e.g. tube) with interior (e.g. internal) screw threads 227 that correspond (or are matching with) the exterior (e.g. external) screw threads 207 of the first hollow-tubular-connecting-structure 202, the second welding joint 225 (e.g. full welding joint) to create a strong connection between the second hollow-tubular-connecting-structure 222 and the second plate 221, and the hexagonal-shaped opening 28 in the middle of the second plate 221 which allow the use of a hex key to loosen or tighten the second connection part 220 to the first connection part 200.

According to various embodiments, a levelling or lifting system may be provided.

Referring to FIGS. 1A to 2F, the levelling or lifting system, according to various embodiments may include the connection assembly 1, 1*a*, 1*b*, the slab 2, and the bolt 9.

According to various embodiments, the levelling or lifting system may include only or consist of the connection assembly 1, 1*a*, 1*b*, the slab 2 and the bolt 9.

FIG. 3A shows a schematic view of the slab 2 of the levelling or lifting system according to various embodiments, in detail.

According to various embodiments, the slab 2 of the levelling or lifting system may be a solid slab (or an already hardened slab). According to various embodiments, the slab 2 of the levelling or lifting system may be a concrete slab, stone slab or precast slab of any material that is suitable for casting a solid slab. According to various embodiments, the slab 2 of the levelling or lifting system may be a Precast Ultra-thin Whitetopping (PUTW) pavement slab or any other precast concrete slab that is handled and constructed in a similar manner as a PUTW pavement slab.

According to various embodiments, the slab 2 of the levelling or lifting system may include the through-hole 3 (i.e. connection-through-hole 3) that extends between the two opposite surfaces 2*a*, 2*b* (or sides) of the slab 2. According to various embodiments, the through-hole 3 (i.e. connection-through-hole 3) of the slab 2 may have a diameter that is equal to or larger than the outer diameter of the second hollow-tubular-connecting-structure 122, 222 so as to accommodate or house the second hollow-tubular-connecting-structure 122, 222 as well as the first hollow-tubular-connecting-structure 102, 202 that is inserted in the second hollow-tubular-connecting-structure 122, 222.

According to various embodiments, the slab 2 may include the through-hole 3 (i.e. connection-through-hole 3) that is configured or adapted to accommodate or house the second hollow-tubular-connecting-structure 122, 222 as well as the first hollow-tubular-connecting-structure 102, 202 that is inserted in the second hollow-tubular-connecting-structure 122, 222 such that the slab 2 is free of or without any element or member embedded or included in the slab 2 (e.g. in the solid portion of the solid slab 2), in a manner having only the connection assembly 1, 1*a*, 1*b* retrofitted to the slab 2 through the space defined by the connection-through-hole 3 to sandwich (i.e. clamp) the slab 2 between the first clamping member 101, 201 and the second clamping member 121, 221.

According to various embodiments, the slab 2 may further include another hole 6 (i.e. anchoring hole 6) that is configured or adapted to receive or house the anti-rotation element 7 of the connection assembly 1*a*, 1*b* of the levelling or lifting system.

According to various embodiments, the slab 2 of the levelling or lifting system may be free of or without any element or member embedded or included in the slab 2 (e.g. in the solid portion of the solid slab 2).

According to various embodiments, the anchoring hole 6 may be a separate hole or recess from the connection-through-hole 3. According to various embodiments, the anchoring hole 6 may be a shaped-hole (e.g. polygonal-shaped hole, such as a square-shaped hole), a blind hole or a through-hole that extends inwardly into the slab 2 from one surface of the slab 2 (e.g. surface 2*a*) and is positioned adjacent to the connection-through-hole 3 as shown in FIG. 3A (in other words, a central axis of the anchoring hole 6 does not coincide with a central axis of the connection-through-hole 3).

According to various embodiments, the first hollow-tubular-connecting-structure 202 of the first connection part 200 may be inserted into the connection-through-hole 3 of the slab 2 from the first surface 2*a* of the slab 2 together with the anti-rotation element 7 inserted into (and engaged with) the anchoring hole 6 of the slab 2. Accordingly, with the anti-rotation element 7 inserted into (and engaged with) the anchoring hole 6 of the slab 2, the anti-rotation element 7 may cooperate with the anchoring hole 6 to impede a rotation of the first connection part 200 relative to the slab 2 about the connection axis 4, while the second connection part 120, 220 is connected to the first connection part 200. For example, when the first engagement element 204 of the first connection part 200 includes exterior screw threads and the second engagement element 124, 224 of the second connection part 120, 220 includes interior screw threads, the anti-rotation element 7 may cooperate with the anchoring hole 6 to impede the rotation of the first connection part 200 about the connection axis 4 when the second connection part 120, 220 is rotated with respect to the first connection part 200 to threadedly engage the first engagement element 204 and the second engagement element 124, 224 to form the connection within the through-hole 3 of the slab 2.

According to various embodiments, the slab 2 of the levelling or lifting system may be a cube, a cuboid or having any other suitable shape and size adapted to be sandwiched between the first clamping member 101, 201 and the second clamping member 121, 221 of the connection assembly 1, 1*a*, 1*b* of the levelling or lifting system.

According to various embodiments, the bolt of the levelling or lifting system may be a lifting bolt and/or levelling bolt (see for example FIG. 3B and FIG. 3C).

FIG. 3B shows a perspective view of a lifting bolt 9*a* of the levelling or lifting system according to various embodiments.

According to various embodiments, the lifting bolt 9*a* (e.g. lifting eye bolt) may include a lifting element 14 at an end of the lifting bolt 9*a* for lifting the slab 2, for example, via a lifting device (e.g. crane, pulley etc.) (not shown). According to various embodiments, the lifting element 14 may include a hook or a loop (e.g. lifting eye, lug, eyelet etc.).

According to various embodiments, the lifting bolt 9*a* may be connected to the slab 2 of the levelling or lifting system by screwing the lifting bolt 9*a* into the first hollow-tubular-connecting-structure 102, 202 of the first connection part 100, 200 through the opening 26, 28 in the second clamping member 121, 221 of the second connection part 120, 220 in a manner such that the lifting bolt 9*a* is in threaded engagement with the threaded interior wall surface of the first hollow-tubular-connecting-structure 102, 202 to lift the slab 2 (e.g. via the lifting device).

FIG. 3C shows a perspective view of a levelling bolt 9*b* of the levelling or lifting system according to various embodiments According to various embodiments, the levelling bolt 9*b* may have a length greater than a thickness of the slab 2. In other words, the levelling bolt 9*b* may have a length that is greater than a perpendicular distance between the first clamping member 201 and the second clamping member 121, 221 (e.g. when first clamping member 201 and the second clamping member 121, 221 sandwich or clamp the slab 2 therebetween).

According to various embodiments, the levelling bolt 9*b* may be screwed into the first hollow-tubular-connecting-structure 202 of the first connection part 200 through the opening 26, 28 in the second clamping member 121, 221 of the second connection part 120, 220 such that the levelling bolt 9*b* penetrates the first connection part 200 to protrude from the opening 24 of the first clamping member 201. The protruding portion of the levelling bolt 9*b* from the opening 24 of the first clamping member 201 may urge against the external surface 5 (e.g. ground 5) to level the slab 2 at a desired or predetermined elevation or distance from the external surface 5 (see, for example, FIG. 2D).

According to various embodiments, the bolt 9 of the levelling or lifting system may be both a lifting and levelling bolt. For example, the lifting and levelling bolt may have a length greater than a thickness of the slab 2 and may also include the lifting element 14 according to various embodiments.

According to various embodiments, there is provided a method of fabricating the connection assembly 1, 1*a*, 1*b* according to various embodiments.

According to various embodiments, the method of fabricating the connection assembly 1, 1*a*, 1*b* may include the following.

According to various embodiments, the method may include providing the first hollow-tubular-connecting-structure 102, 202 having the first engagement element 104, 204 of an exterior wall surface 11*b*, 12*b* of the first hollow-tubular-connecting-structure 102, 202.

According to various embodiments, the method may include attaching the first hollow-tubular-connecting-structure 102, 202 to the first clamping member 101, 201 in a manner such that the first hollow-tubular-connecting-structure 102, 202 extends from the first clamping member 101, 201 to form the first connection part 100, 200 of the connection assembly 1, 1*a*, 1*b*. According to various embodiments, attaching the first hollow-tubular-connecting-structure 102, 202 to the first clamping member 101, 201 may include welding the first hollow-tubular-connecting-structure 102, 202 to the first clamping member 101, 201 to form a first welding joint 205 between the first hollow-tubular-connecting-structure 102, 202 and the first clamping member 101, 201.

According to various embodiments, the method may include attaching or providing the anti-rotation 7 element (e.g. protruding structure 8), onto the first clamping member 201 in a manner such that that the anti-rotation element 7 extends from the first clamping member 201 in the same extension direction as the first hollow-tubular-connecting-structure 202.

According to various embodiments, the method may include providing the second hollow-tubular-connecting-structure 122, 222 having the second engagement element 124, 224 of the interior wall surface 22*a*, 23*a* of the second hollow-tubular-connecting-structure 122, 222.

According to various embodiments, the method may include attaching the second hollow-tubular-connecting-structure 122, 222 to the second clamping member 121, 221 in a manner such that the second hollow-tubular-connecting-structure 122, 222 extends from the second clamping member 121, 221 to form the second connection part 120, 220 of the connection assembly 1, 1*a*, 1*b*. According to various embodiments, attaching the second hollow-tubular-connecting-structure 122, 222 to the second clamping member 121, 221 may include welding (e.g. full welding) the second hollow-tubular-connecting-structure 122, 222 to the second clamping member 121, 221 to form a second welding joint 225 (e.g. full welding joint) between the second hollow-tubular-connecting-structure 122, 222 to the second clamping member 121, 221.

According to various embodiments, the method may include providing a kit including the first connection part 100, 200 and the second connection part 120, 220 which are configured such that the first connection part 100, 200 and the second connection part 120, 220 may be connectable to each other to form the connection assembly 1, 1*a*, 1*b* of the various embodiments.

According to various embodiments, there is provided a method of setting up the levelling or lifting system according to various embodiments.

According to various embodiments, the method of setting up the levelling or lifting system may include the following.

According to various embodiments, the method may include inserting the first hollow-tubular-connecting-structure 102, 202 of the first connection part 100, 200 into the through-hole 3 of the slab 2. The method may include inserting the second hollow-tubular-connecting-structure 122, 222 of the second connection part 120, 220 into the through-hole 3 of the slab 2 with the second hollow-tubular-connecting-structure 122, 222 directed towards the first hollow-tubular-connecting-structure 102, 202 and aligned to the first hollow-tubular-connecting-structure along the connection axis 4 which extends through the through-hole 3 of the slab 2 between the two opposite surfaces 2*a*, 2*b* of the slab 2. The method may include connecting the first connection part 100, 200 and the second connection part 120, 220 to each other to form the connection assembly 1, 1*a*, 1*b*. According to various embodiments, connecting the first connection part 100, 200 and the second connection part 120, 220 may include connecting the first hollow-tubular-connecting-structure 102, 202 and the second hollow-tubular-connecting-structure 122, 222 to form the connection (i.e. between the first hollow-tubular-connecting-structure 102, 202 and the second hollow-tubular-connecting-structure 122, 222) along the connection axis 4 within the through-hole 3 of the slab 2 and with the first engagement element 104, 204 of the exterior wall surface 11*b*, 12*b* of the first hollow-tubular-connecting-structure 102, 202 and the second engagement element 124, 224 of the interior wall surface 22*a*, 23*a* of the second hollow-tubular-connecting-structure 120, 220 engaged to each other in a manner so as to sandwich the slab 2 between the first clamping member 101, 201 and the second clamping member 121, 221 between the two opposite surfaces 2*a*, 2*b* of the slab 2.

According to various embodiments, the method may include connecting the bolt 9 (e.g. lifting or levelling bolt) to the slab 2, via connecting the bolt 9 to the connection assembly 1, 1*a*, 1*b*. According to various embodiments, connecting the bolt 9 (e.g. lifting or levelling bolt) to the slab 2 may include screwing the bolt 9 into the first hollow-tubular-connecting-structure 102, 202 of the first connection part 100, 200 through the opening 26, 28 in the second clamping member 121, 221 of the second connection part 120, 220 in a manner such that the bolt 9 (e.g. lifting or levelling bolt) is in threaded engagement with the threaded interior wall surface 11*a*, 12*a* of the first hollow-tubular-connecting-structure 120, 220.

According to various embodiments, the method may further include, prior to inserting and connecting the first hollow-tubular-connecting-structure 102, 202 of the first connection part 100, 200 and the second hollow-tubular-connecting-structure 122, 222 of the second connection part 120, 220 to each other to form the connection assembly 1, 1*a*, 1*b*, forming the through-hole 3 (i.e. the connection-through-hole 3) in the slab 2, which extends between the two opposite surfaces 2*a*, 2*b* of the slab 2. According to various embodiments, forming the through-hole 3 (i.e. the connection-through-hole) in the slab 2 may include drilling (e.g. core drilling using a drilling device) the slab 2 from the first surface 2*a* of the slab 2 to (e.g. towards) another surface 2*b* of the slab 2 that is opposite the first surface 2*a* to form the through-hole 3, or vice versa.

According to various embodiments, the method may further include forming another hole (i.e. anchoring hole 6) in the slab 2 (e.g. from the first surface 2*a* or from another surface 2*b* of the slab 2) that is configured or adapted to receive the anti-rotation element 7 of the first connection part 200 prior to connecting the first connection part 200 and the second connection part 120, 220 to each other to form the connection assembly 1*a*, 1*b*. According to various embodiments, the method may further include, after forming the anchoring hole 6, inserting the anti-rotation element 7 into the anchoring hole 6 as the first hollow-tubular-connecting-structure 202 is inserted into the connection-through-hole 3 of the slab 2.

According to various embodiments, when the first engagement element 104, 204 includes exterior screw threads 207 and the second engagement element 124, 224 includes interior screw threads 227, connecting the first connection part 100, 200 and the second connection part 120, 220 to each other may further include screwing or rotating the first connection part 100, 200 relative to the second connection part 120, 220 to form a threaded connection along the connection axis 4, after (or upon) inserting the second hollow-tubular-connecting-structure 122, 222 into the through-hole 3 of the slab 2 in a manner such that the first hollow-tubular-connecting-structure 102, 122 is inserted into the second hollow-tubular-connecting-structure 122, 222. According to various embodiments, screwing or rotating the first connection part 100, 200 with respect to the second connection part 120, 220 may include inserting a key into the opening 26 (e.g. hexagonal-shaped opening 28) of the second clamping member 121, 221 to tighten the second connection part 120, 220 to the first connection part 100, 200.

Accordingly, according to various embodiments, to attach the connection assembly 1, 1*a*, 1*b* to the slab 2 (e.g. a precast slab), the slab 2 may be firstly core drilled to form the through-hole 3 having a slightly larger diameter than the second hollow-tubular-connecting-structure 122, 222 (e.g. tube on the top part of the connection assembly 1, 1*a*, 1*b*) for accommodating both the second hollow-tubular-connecting-structure 122, 222 and the first hollow-tubular-connecting-structure 102, 202 inserted thereto. Another hole 6 (e.g. small hole) to accommodate the anti-rotation member 7 may further be drilled on one side of the slab 2 accordingly. The first hollow-tubular-connecting-structure 102, 202 (e.g. tube on the bottom part of the connection assembly 1, 1*a*, 1*b*) is inserted into through-hole 3 on the side of the slab 2 having the other hole 6 (e.g. small hole), with the anti-rotation member 7 (e.g. cylindrical structure) fitting (or fitted) into the other hole 6 (e.g. small hole). The second hollow-tubular-connecting-structure 122, 222 (e.g. tube on the top part of the connection assembly 1, 1*a*, 1*b*) may be inserted into the through-hole 3 on the opposite side of the slab 2. The first connection part 100, 200 and second connection part 120, 220 (e.g. top and bottom parts of the connection assembly 1, 1*a*, 1*b*) may then be tightened together, via engagement members 104, 204, 124, 224, (e.g. matching threads), using a hex key inserted into the opening 26, 28 in the second clamping member 121, 221 of the second connection part 120, 220.

According to various embodiments, there is provided a method of lifting the slab 2 according to various embodiments.

According to various embodiments, the method of lifting the slab 2 may include the following.

According to various embodiments, the method may include assembling the connection assembly 1*a*, 1*b* to the slab 2, in a manner so as to sandwich the slab 2 between the first clamping member 201 (i.e. of the first connection part 200 of the connection assembly 1*a*, 1*b*) and the second clamping member 121, 221 of the second connection part 120, 220 of the connection assembly 1*a*, 1*b* and with the connection between the first hollow-tubular-connecting-structure 202 (i.e. of the first connection part 200 of the connection assembly 1*a*, 1*b*) and the second hollow-tubular-connecting-structure 122, 222 of the second connection part 120, 220 of the connection assembly 1*a*, 1*b* within the through-hole 3 in the slab 2.

According to various embodiments, the method may include connecting the lifting bolt 9*b* to the slab 2, with the connection assembly 1*a*, 1*b*, by connecting (e.g. screwing) the lifting bolt 9*b* into the first hollow-tubular-connecting-structure 202 of the first connection part 200 through the opening 26, 28 in the second clamping member 121, 221 of the second connection part 120, 220.

According to various embodiments, the method may include lifting the slab 2 by the lifting bolt 9*b*, for example, by attaching a lifting device (not shown) to the lifting bolt 9*b* to lift the slab 2.

According to various embodiments, there is provided a method of levelling the slab 2 according to various embodiments.

According to various embodiments, the method of levelling the slab 2 may include the following.

According to various embodiments, the method may include assembling the connection assembly 1*a*, 1*b* to the slab 2, in a manner so as to sandwich the slab 2 between the first clamping member 201 (i.e. of the first connection part 200 of the connection assembly 1*a*, 1*b*) and the second clamping member 121, 221 of the second connection part 120, 220 of the connection assembly 1*a*, 1*b* and with the connection between the first hollow-tubular-connecting-structure 202 (i.e. of the first connection part 200 of the connection assembly 1*a*, 1*b*) and the second hollow-tubular-connecting-structure 122, 222 of the second connection part 120, 220 of the connection assembly 1*a*, 1*b* within the through-hole 3 in the slab 2.

According to various embodiments, the method of levelling the slab 2 may include connecting the levelling bolt 9*b* to the connection assembly 1*a*, 1*b* by connecting (e.g. screwing) the levelling bolt 9*b* into the first hollow-tubular-connecting-structure 202 of the first connection part 200 through the opening 26, 28 in the second clamping member 121, 221 of the second connection part 120, 220 in a manner such that the levelling bolt 9*b* penetrates the first hollow-tubular-connecting-structure 202 of the first connection part 200 and protrudes from the opening 24 of the first clamping member 201 of the first connection part 200 to urge against the external surface 5 (e.g. ground 5). According to various embodiments, if the ground 5 is not stiff enough to withstand the weight of the slab 2 (as well as the weight of people atop carrying out the levelling operations of the slab 2), a metal plate may be placed between the protruding portion of the levelling bolt 9*b* and the ground 5 to prevent the levelling bolt 9*b* from penetrating the ground 5 such that it would not be possible to level the slab 2.

According to various embodiments, the method of levelling the slab 2 may include adjusting a levelling height of the slab 2 to a desired or predetermined height with respect to the external surface 5 by screwing (e.g. screwing fully) or unscrewing the levelling bolt 9*b* relative to the connection assembly 1*a*, 1*b* in a manner such that a length of the protruding portion of the levelling bolt 9*b* measured from the first clamping member 201 to the ground 5 correspond to the desired height. A tip of the protruding portion of the levelling bolt 9*b* may urge against the external surface 5, e.g. ground 5, to level the slab 2 at the desired height from the surface 5. During levelling, the first connection part 200 (e.g. bottom part of the connection assembly 1*a*, 1*b* when in use/operation) may remain connected or engaged with the second connection part 120, 220 (e.g. top part of the connection assembly 1*a*, 1*b* when in use/operation) and the slab 2.

According to various embodiments, the length of the protruding portion of the levelling bolt 9*b* that protrudes from the opening 24 of the first clamping member 201 of the first connection part 200 may be adjusted by the screwing or unscrewing of the levelling bolt 9*b* relative to the connection assembly 1*a*, 1*b*. For example, when the levelling bolt 9*b* is screwed relative to the connection assembly 1*a*, 1*b* (i.e. to move in a direction from the opening 26, 28 in the second clamping member 121, 221 towards the first clamping member 201), the length of the portion of the levelling bolt 9*b* that protrudes from the opening 24 of the first clamping member 201 may be increased or increases with the screwing of the levelling bolt 9*b*. In other words, the more (e.g. deeper) the levelling bolt 9*b* is screwed into the connection assembly 1*a*, 1*b*, the higher the connection assembly 1*a*, 1*b* (e.g. first clamping member 201 of the connection assembly 1*a*, 1*b*) and the slab 2 will be from the surface 5. Conversely, when the levelling bolt 9*b* is unscrewed relative to the connection assembly 1*a*, 1*b* (i.e. to move in a direction away from the first clamping member 201 and towards the opening 26, 28 in the second clamping member 121, 221), the length of the portion of the levelling bolt 9*b* that protrudes from the opening 24 of the first clamping member 201 may be decreased or decreases with the unscrewing of the levelling bolt 9*b*.

According to various embodiments, when the slab 2 is levelled to a desired or predetermined height with respect to the external surface 5 (e.g. ground 5), a gap 29 (see, for example, FIG. 2D) is formed between the slab 2 and the external surface 5. According to various embodiments, the method of levelling the slab 2 may include filling the gap 29 between the slab 2 and the external surface 5 (e.g. ground 5) with a filler material 27 (e.g. grout).

According to various embodiments, the method of levelling the slab 2 may further include disconnecting the levelling bolt 9*b* from the connection assembly 1*a*, 1*b* by unscrewing the levelling bolt 9*b*. According to various embodiments, disconnecting of the levelling bolt 9*b* from the connection assembly 1*a*, 1*b* may occur after setting the filler material 27 (e.g. grout) (e.g. for a predetermined duration) such that the filler material 27 sets or hardens.

According to various embodiments, the method of levelling the slab 2 may further include disassembling the connection assembly 1*a*, 1*b* by separating the second connection part 120, 220 from the first connection part 200. According to various embodiments, disassembling of the connection assembly 1*a*, 1*b* by separating the second connection part 120, 220 from the first connection part 200 may similarly occur after the filler material 27 sets or hardens and may occur after the disconnecting of the levelling bolt 9*b* from the connection assembly 1*a*, 1*b*. According to various embodiments, when the second connection part 120, 220 is being separated from the first connection part 200, the first connection part 200 may remain engaged or in contact with the slab 2 and/or the filler material 27, whereas the second connection part 120, 220 may be disengaged or removed from the slab 2 and the filler material 27. Accordingly, according to various embodiments, after levelling or lifting of the slab 2, for example, in installation of pavement using the slab 2, the second connection part 120, 220 (e.g. top part) can be removed or separated from the connection assembly 1*a*, 1*b* before opening the pavement to traffic. Furthermore, the disengaged second connection part 120, 220 may be reusable, whereas the remaining first connection part 200 may be used for future levelling or lifting by connecting a new second connection part 120, 220 thereto.

According to various embodiments, the method of levelling the slab 2 may include assembling a plurality of connection assemblies 1, 1*a*, 1*b* (e.g. four connection assemblies 1, 1*a*, 1*b*) to the slab 2 (e.g. at the four corners of the precast slab 2) and connecting respective levelling bolts 9*b* to respective connection assemblies 1, 1*a*, 1*b*. Thereafter, adjusting a levelling height or gradient of the slab 2 to a desired or predetermined height or gradient with respect to the external surface 5 (e.g. ground 5) by screwing or unscrewing respective levelling bolts 9*b* of corresponding respective connection assemblies 1, 1*a*, 1*b*. Then, filling the gap 29 between the slab 2 and the external surface 5 with grout. Thereafter, waiting for the grout to set to a desired or predetermined strength (or viscosity etc.). The method may include disconnecting the levelling bolts 9*b* from the connection assemblies 1, 1*a*, 1*b*. The method may include disassembling the connection assemblies 1, 1*a*, 1*b* by separating respective first connection parts 100, 200 from respective second connection parts 120, 220 of the connection assemblies 1, 1*a*, 1*b*. A pavement may be made according to the method described herein, which may then be open to allow traffic to pass.

Figure 4A:
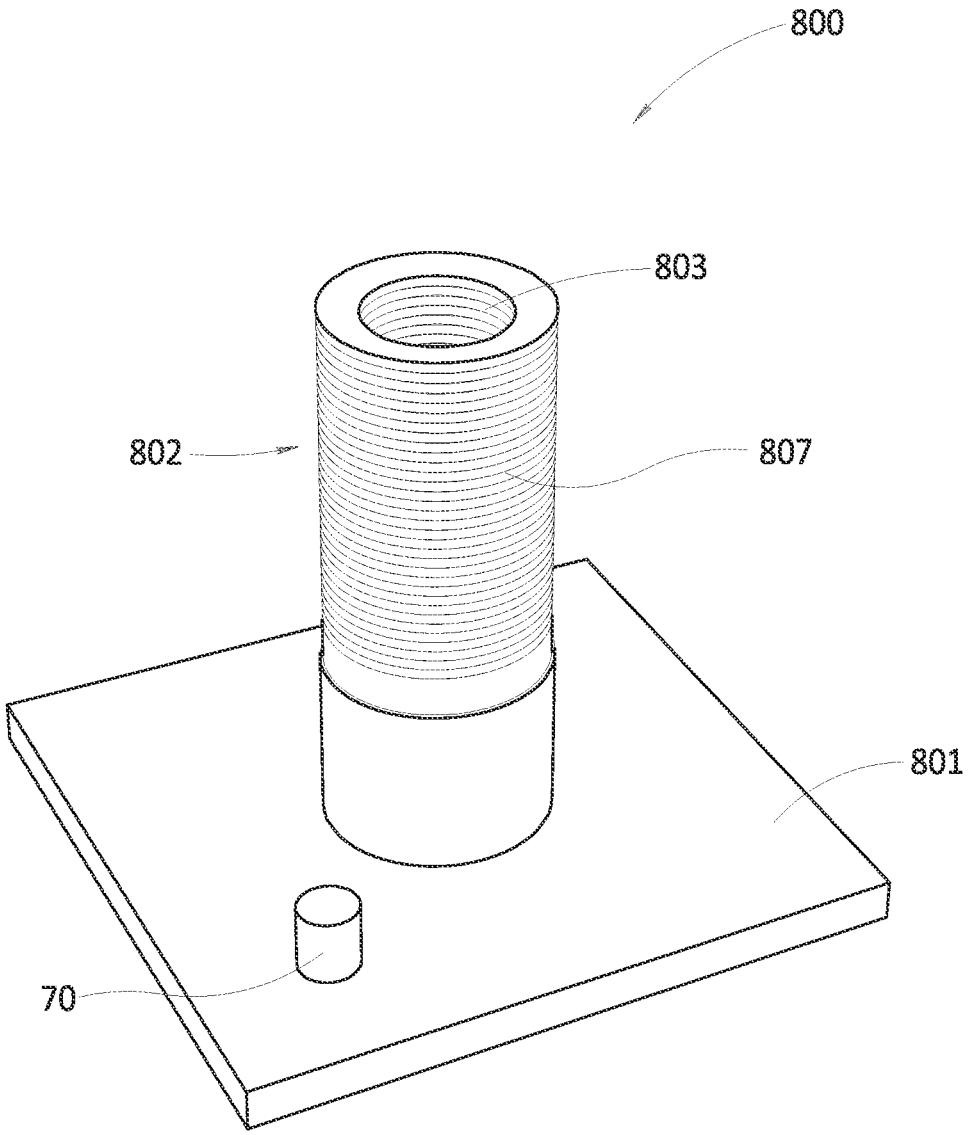
FIG. 4A shows a photograph of a manufactured sample of a first connection part according to various embodiments.

FIG. 4A shows a photograph of a manufactured sample of a first connection part 800 according to various embodiments.

According to various embodiments, the first connection part 800 of FIG. 4A may be similar or identical to the first connection part 200 of FIG. 2A and FIG. 2B.

According to various embodiments, the first connection part 800 may, likewise to the first connection part 200 of FIG. 2A and FIG. 2B, include a first clamping member 801. As shown in FIG. 4A, according to various embodiments, the first clamping member 801 may be a square plate 801 (or first plate 801).

According to various embodiments, the first connection part 800 may, likewise to the first connection part 200 of FIG. 2A and FIG. 2B, include a first hollow-tubular-connecting-structure 802. The first hollow-tubular-connecting-structure 802 may, likewise to the first connection part 200 of FIG. 2A and FIG. 2B, include interior screw threads 803 and exterior screw threads 807.

As shown in FIG. 4A, the manufactured sample of the first clamping member 801 of the first connection part 800 may be a square stainless-steel plate 801 (e.g. base plate). The first connection part 800 may have dimensions of 80 mm×80 mm, 90 mm×90 mm, or 100 mm×100 mm. The first hollow-tubular-connecting-structure 802 may be a 70 mm long stainless-steel tube, extending from the first clamping member 801, with 40 mm deep M30×2.5 threads 807 outside and full M20×2.5 threads 803 inside. The first hollow-tubular-connecting-structure 802 may be fully welded to the first clamping member 801.

According to various embodiments, the first connection part 800 may, likewise to the first connection part 200 of FIG. 2A and FIG. 2B, include an anti-rotation element 70.

The anti-rotation element 70 of the first clamping member 801 may be a 10 mm tall cylindrical structure (having a diameter 10 mm) that is bolted directly to the first clamping member 801.

Figure 4B:
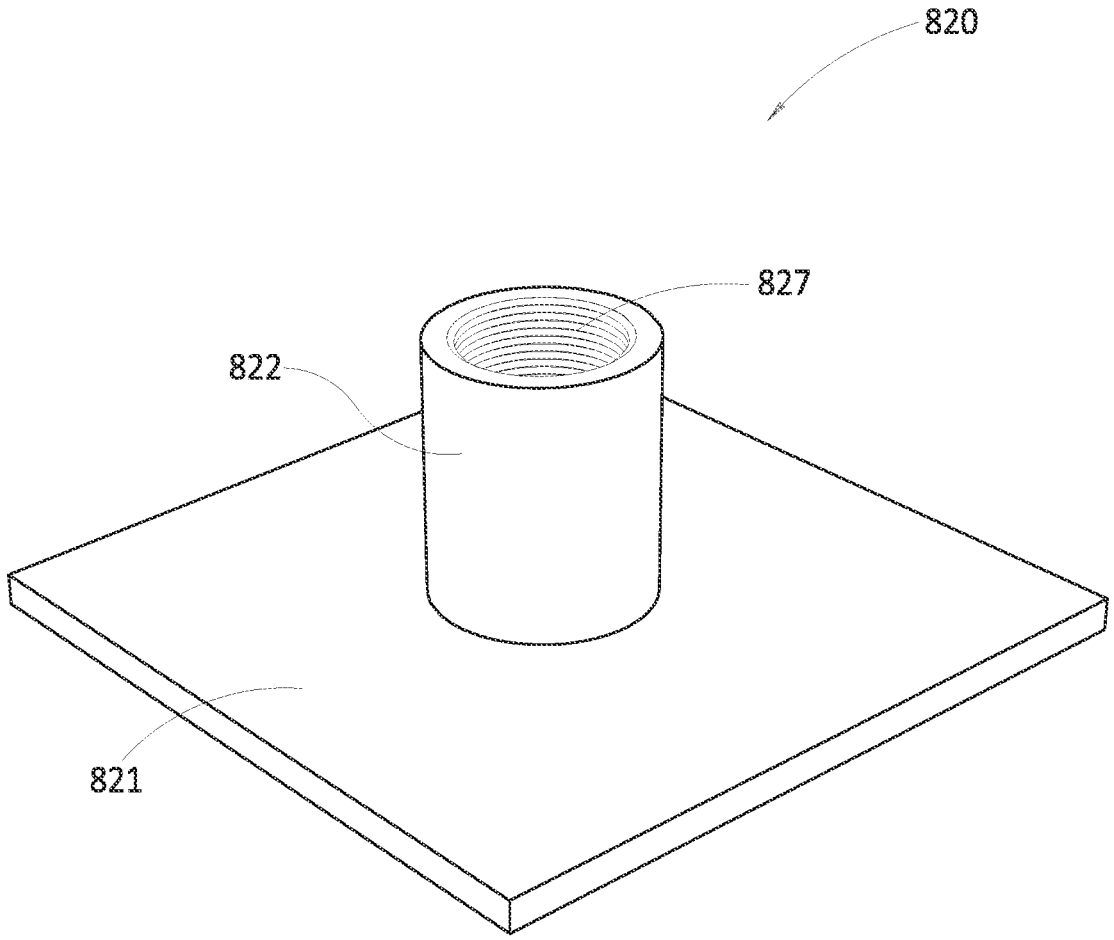
FIG. 4B shows a photograph of a manufactured sample of a second connection part according to various embodiments.

FIG. 4B shows a photograph of a manufactured sample of a second connection part 820 according to various embodiments.

According to various embodiments, the second connection part 820 of FIG. 4B may be similar or identical to the second connection part 220 of FIG. 2E and FIG. 2F.

According to various embodiments, the second connection part 820 may, likewise to the second connection part 220 of FIG. 2A and FIG. 2B, include a second clamping member 821. As shown in FIG. 4B, according to various embodiments, the second clamping member 821 may be a square plate 821 (or second plate 821).

According to various embodiments, the second connection part 820 may, likewise to the second connection part 220 of FIG. 2A and FIG. 2B, include a second hollow-tubular-connecting-structure 822. The second hollow-tubular-connecting-structure 822 may, likewise to the second connection part 200 of FIG. 2A and FIG. 2B, include interior screw threads 827.

As shown in FIG. 4B, the manufactured sample of the second clamping member 821 of a second connection part 820 may be a square stainless-steel plate 821 (e.g. top plate) with dimensions of 120 mm×120 mm. The second hollow-tubular-connecting-structure 822 may be a 40 mm long stainless-steel tube, extending from the second clamping member, with an outer diameter of 36 mm and M30×2.5 thread 827 inside. The second hollow-tubular-connecting-structure 822 may be fully welded to the second clamping member 821.

Figure 4C:
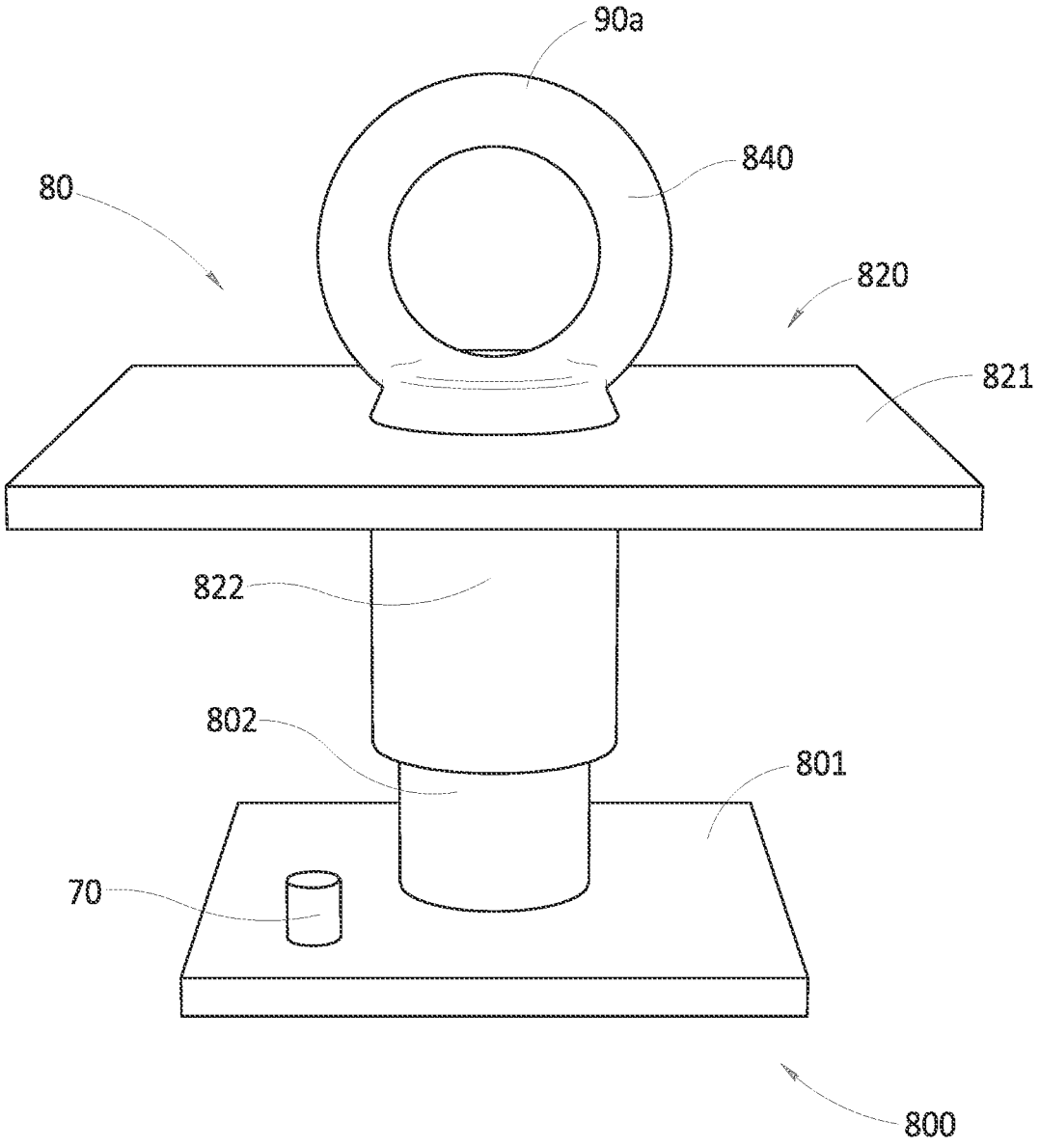
FIG. 4C shows a photograph of the first connection part of FIG. 4A connected to the second connection part of FIG. 4B, with a lifting bolt, according to various embodiments.

FIG. 4C shows a photograph of the first connection part 800 of FIG. 4A connected to the second connection part 820 of FIG. 4B, with a lifting bolt 90*a*, according to various embodiments.

According to various embodiments, the first connection part 800 is connected to the second connection part 820 to form a connection assembly 80.

According to various embodiments, the lifting bolt 90*a* may be provided to be connected to the connection assembly 80 for lifting a slab with connection assembly 80 retrofitted thereto.

According to various embodiments, the lifting bolt 90*a* may be similar or identical to the lifting bolt 9*a* of FIG. 3B.

Figure 4D:
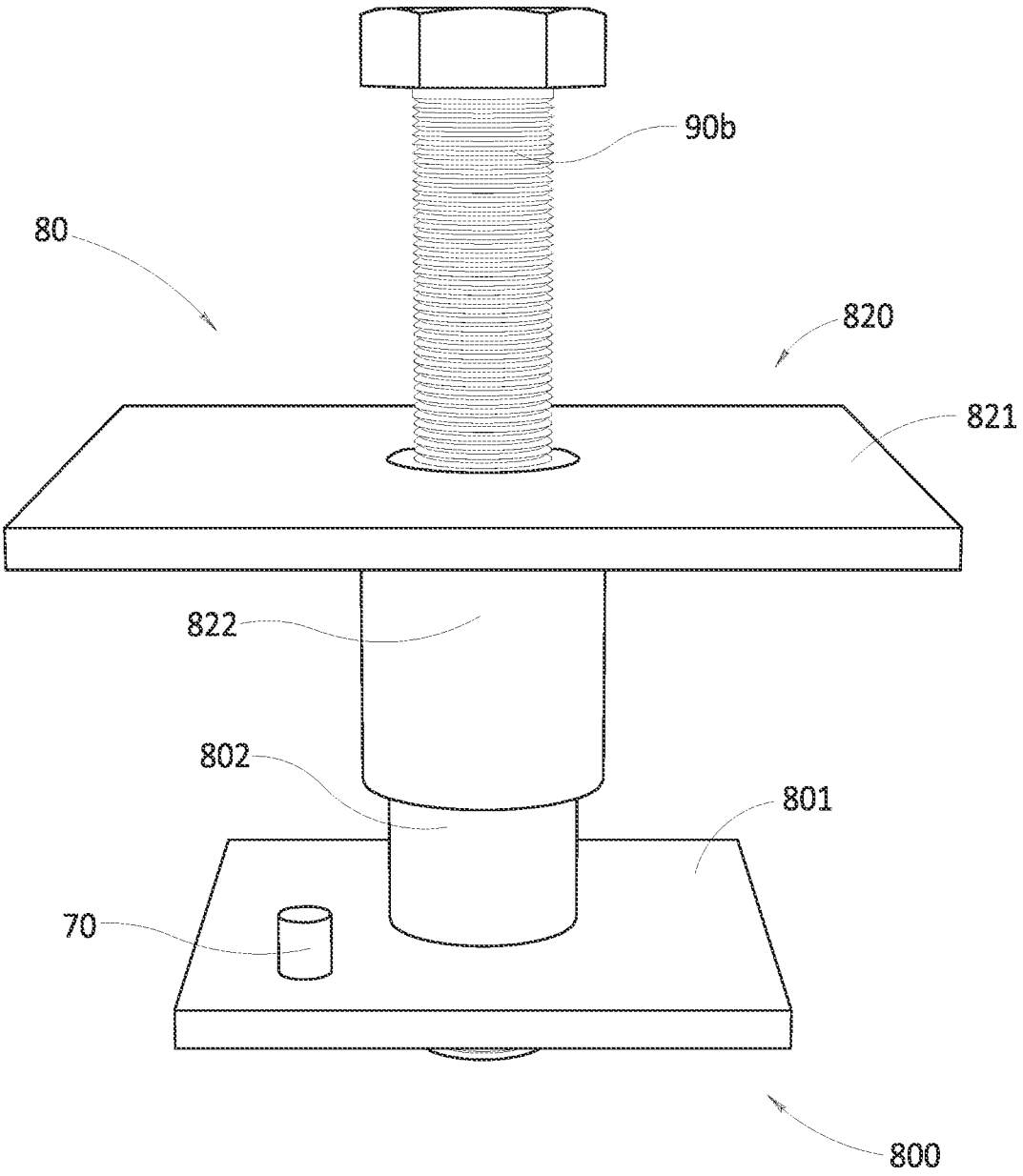
FIG. 4D shows a photograph of the first connection part of FIG. 4A connected to the second connection part of FIG. 4B, with a levelling bolt, according to various embodiments.

FIG. 4D shows a photograph of the first connection part 800 of FIG. 4A connected to the second connection part 820 of FIG. 4B, with a levelling bolt 90*b*, according to various embodiments.

According to various embodiments, a levelling bolt 90*b* may be provided to be connected to the connection assembly 80 for levelling a slab with connection assembly 80 retrofitted thereto.

According to various embodiments, the levelling bolt 90*b* may be similar or identical to the levelling bolt 9*b* of FIG. 3C.

Figure 4E:
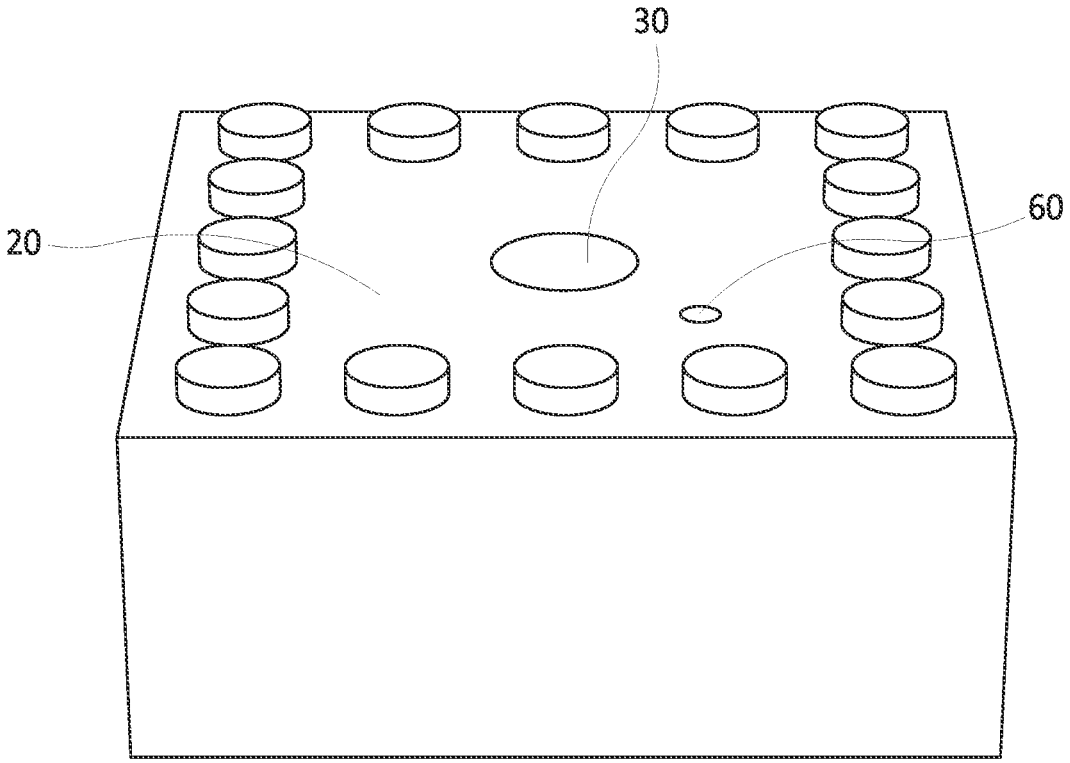
FIG. 4E shows a photograph of a slab having a connection-through-hole and an anchoring hole according to various embodiments.

FIG. 4E shows a photograph of a slab 20 (e.g. concrete slab) having a connection-through-hole 30 and an anchoring hole 60 according to various embodiments.

According to various embodiments, the slab 20 (e.g. concrete slab) may be similar or identical to the slab 2 of FIG. 3A.

As shown in FIG. 4E, the slab 20 may include the connection-through-hole 30 and the anchoring hole 60. According to various embodiments, the slab 20 may be core drilled to create the connection-through-hole 30 and the anchoring hole 60 before installing or retrofitting the connection assembly 80 to the slab 20.

Figure 4F:
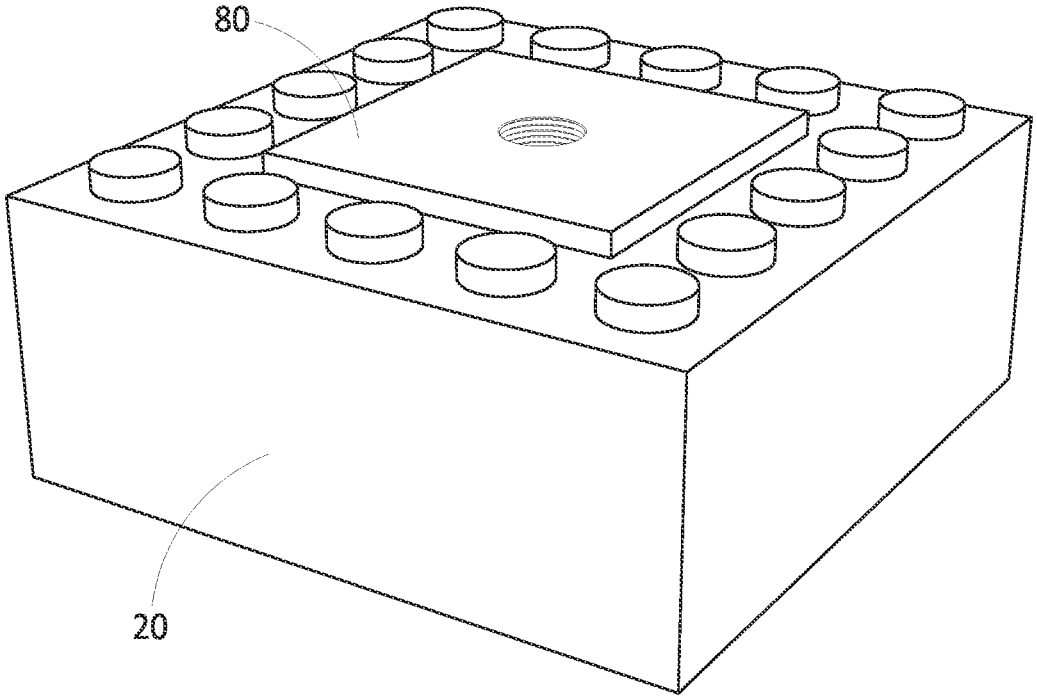
FIG. 4F shows a photograph of the connection assembly retrofitted to the slab according to various embodiments.

FIG. 4F shows a photograph of the connection assembly 80 of FIG. 4C and FIG. 4D retrofitted to the slab 20 according to various embodiments.

According to various embodiments, lifting bolt 90*a* or levelling bolt 90*b* may be connected to the connection assembly 80 retrofitted to the slab 20 to form a levelling or lifting system.

Figure 4G:
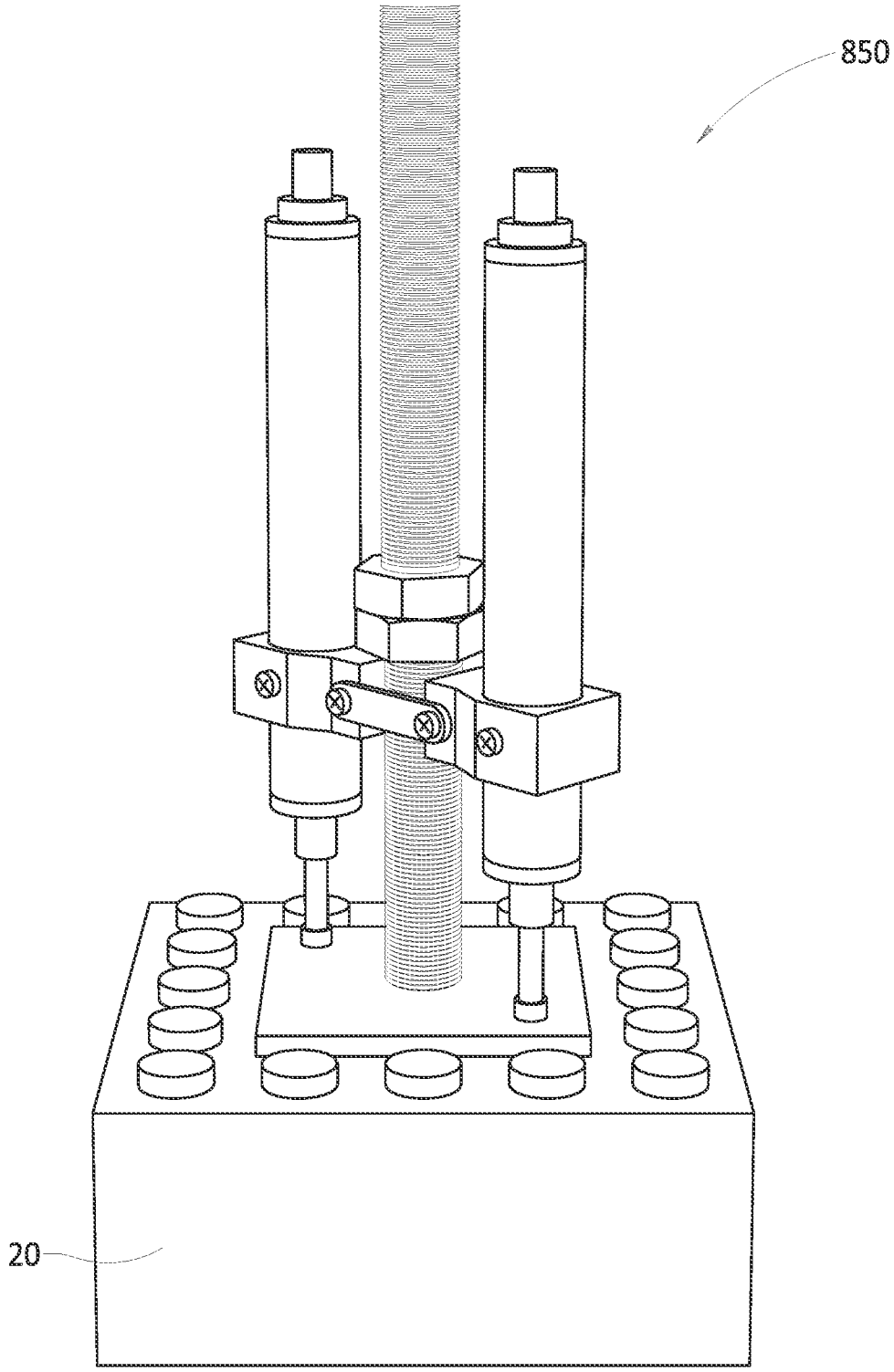
FIG. 4G shows a photograph of a test set-up for testing load capacities of connection assemblies according to various embodiments.

FIG. 4G shows a photograph of a test set-up for testing load capacities of connection assemblies 80 according to various embodiments.

A series of tests had been conducted on twelve samples of the first connection parts 800, using the test set-up 850 as shown in FIG. 4G, to evaluate the load capacity of the first connection part 800 of the connection assembly 80. Using the test set-up 850, a compression load may be applied to the connection assembly 80 during the test. The test results showed that all twelve samples (i.e. first connection parts 800) can withstand very well increasing loads of up to 50 kN without any sign of damage or plastic deformation. Four samples 800 were chosen randomly for testing the ultimate load capacity. The lowest load capacity was observed to be 73.88 kN and the average value was 79.94 kN.

Four samples of second connection parts 820 were also tested to resemble the slab 20 being lifted bottom-up (in other words, lifting the slab 20 by the second connection part 820). Similar to the results achieved in the testing of the first connection parts 800, all four samples (i.e. second connection parts) can also withstand very well increasing loads of up to 50 kN without any sign of damage or plastic deformation. It may be observed that one connection assembly 80 may possibly carry half the weight of a precast slab 20 (e.g. standard precast slab), thereby having a safety factor of 2.0. It can be conservatively concluded that the connection assembly 80 may handle a 5-tonne slab 20, with the lifting load being perpendicular to the clamping member 801, 821 (e.g. plate), in a safe manner.

According to various embodiments, a connection assembly for connecting a bolt to a slab may be provided. The connection assembly may include a first connection part. The first connection part may include a first clamping member and may include a first hollow-tubular-connecting-structure extending from the first clamping member. According to various embodiments, the first hollow-tubular-connecting-structure may have a threaded interior wall surface and an exterior wall surface having a first engagement element. The connection assembly may further include a second connection part. The second connection part may include a second clamping member and may include a second hollow-tubular-connecting-structure extending from the second clamping member. According to various embodiments, the second hollow-tubular-connecting-structure may have an interior wall surface having a second engagement element. According to various embodiments, an inner diameter of the second hollow-tubular-connecting-structure may be equal or larger than an outer diameter of the first hollow-tubular-connecting-structure. According to various embodiments, the second clamping member may include an opening providing access to an inner cavity of the second hollow-tubular-connecting-structure. According to various embodiments, the first connection part and the second connection part may be connectable to each other with the first hollow-tubular-connecting-structure of the first connection part and the second hollow-tubular-connecting-structure of the second connection part aligned along a connection axis and directed towards each other such that the first hollow-tubular-connecting-structure may be insertable into the second hollow-tubular-connecting-structure to form a connection along the connection axis with the first engagement element of the exterior wall surface of the first hollow-tubular-connecting-structure and the second engagement element of the interior wall surface of the second hollow-tubular-connecting-structure engaged to each other.

According to various embodiments, the first connection part and the second connection part may be capable of being assembled to the slab in a manner so as to sandwich the slab between the first clamping member and the second clamping member between two opposite surfaces of the slab and with the connection axis of the connection between the first hollow-tubular-connecting-structure and the second hollow-tubular-connecting-structure extending through a through-hole in the slab which extends between the two opposite surfaces of the slab, whereby the bolt may be connectable to the slab with the connection assembly by screwing the bolt into the first hollow-tubular-connecting-structure of the first connection part for threaded engagement with the threaded interior wall surface of the first hollow-tubular-connecting-structure through the opening of the second clamping member of the second connection part.

According to various embodiments, the first clamping member may include an opening providing access to an inner cavity of the first hollow-tubular-connecting-structure of the first connection part. According to various embodiments, the bolt screwed into the first hollow-tubular-connecting-structure of the first connection part through the opening in the second clamping member of the second connection part may be capable of penetrating the first connection part to protrude from the opening of the first clamping member.

According to various embodiments, the first engagement element may include exterior screw threads. According to various embodiments, the second engagement element may include interior screw threads.

According to various embodiments, the first clamping member may further include an anti-rotation element configured to engage the slab for impeding a rotation of the first connection part about the connection axis. According to various embodiments, the anti-rotation element may include a protruding structure extending from the first clamping member in a same extension direction as the first hollow-tubular-connecting-structure.

According to various embodiments, the first clamping member may include a first plate. According to various embodiments, the first hollow-tubular-connecting-structure may extend perpendicularly from the first plate.

According to various embodiments, the second clamping member may include a second plate. According to various embodiments, the second hollow-tubular-connecting-structure may extend perpendicularly from the second plate.

According to various embodiments, the opening of the second clamping member may be a polygonal-shaped opening having a minimum width equal or larger than an inner diameter of the first hollow-tubular-connecting-structure.

According to various embodiments, the opening of the second clamping member may be a hexagonal-shaped opening.

According to various embodiments, the connection assembly may further include a welding joint connecting the first hollow-tubular-connecting-structure to the first clamping member.

According to various embodiments, a levelling or lifting system for the slab may be provided. The levelling or lifting system may include the connection assembly according to various embodiments. According to various embodiments, the levelling or lifting system may further include the slab and a levelling bolt or a lifting bolt. According to various embodiments of the levelling or lifting system, the first connection part of the connection assembly and the second connection part of the connection assembly may be connected to each other in a manner so as to sandwich the slab between the first clamping member of the first connection part and the second clamping member of the second connection part between two opposite surfaces of the slab. According to various embodiments of the levelling or lifting system, the first hollow-tubular-connecting-structure of the first connection part and the second hollow-tubular-connecting-structure of the second connection part may be aligned along the connection axis which extends through a through-hole of the slab extending between the two opposite surfaces of the slab and are directed towards each other, and the first hollow-tubular-connecting-structure may be inserted into the second hollow-tubular-connecting-structure to form the connection between the first hollow-tubular-connecting-structure and the second hollow-tubular-connecting-structure along the connection axis within the through-hole of the slab. According to various embodiments of the levelling or lifting system, the first engagement element of the exterior wall of the first hollow-tubular-connecting-structure and the second engagement element of the interior wall of the second clamping member may be engaged to each other. According to various embodiments of the levelling or lifting system, the levelling bolt or the lifting bolt may be connected to the slab, for lifting or levelling the slab, by screwing the levelling bolt or the lifting bolt into the first hollow-tubular-connecting-structure of the first connection part through the opening in the second clamping member of the second connection part, whereby the levelling bolt or the lifting bolt is in threaded engagement with the threaded interior wall of the first hollow-tubular-connecting-structure.

According to various embodiments of the levelling or lifting system, the lifting bolt may include a hook at an end of the lifting bolt According to various embodiments of the levelling or lifting system, the levelling bolt may have a length greater than a thickness of the slab.

According to various embodiments, a method of levelling the slab may be provided. According to various embodiments, the method may include assembling the connection assembly according to various embodiments to the slab in a manner so as to sandwich the slab between the first clamping member of the first connection part of the connection assembly and the second clamping member of the second connection part of the connection assembly and with the connection between the first hollow-tubular-connecting-structure and the second hollow-tubular-connecting-structure within a through-hole in the slab. According to various embodiments, the method may further include connecting a levelling bolt to the connection assembly by screwing the levelling bolt into the first hollow-tubular-connecting-structure of the first connection part through the opening in the second clamping member of the second connection part in a manner so as to penetrate the first hollow-tubular-connecting-structure of the first connection part to protrude from the opening of the first clamping member of the first connection part.

According to various embodiments, the method may further include adjusting a levelling height of the slab to a predetermined height with respect to a ground by screwing or unscrewing the levelling bolt relative to the connection assembly.

According to various embodiments, the method may further include filling a gap between the slab and the ground with a filler material.

According to various embodiments, the method may further include disconnecting the levelling bolt from the connection assembly by unscrewing the levelling bolt.

According to various embodiments, the method may further include disassembling the connection assembly by separating the second connection part from the first connection part.

Various embodiments have provided a connection assembly which may be retrofitted to a slab (e.g. precast slab) in a manner so as to provide a reliable and effective connection assembly to which a bolt may be connected for lifting or levelling of the slab. Various embodiments have also provided a levelling or lifting system which includes the connection assembly, the slab and the bolt to enable levelling or lifting of the slab in a reliable and effective manner. Various embodiments have also provided a method of levelling the slab using the connection assembly according to the various embodiments which is reliable and effective. In various embodiments, with the connection assembly being capable of being retrofitted to a precast slab, precast slabs can be used, and the need for casting customized slabs according to a site geometry may be minimized or eliminated, leading to formwork cost savings. Moreover, in the various embodiments, slab geometry change as well as adjustments of lifting and levelling points can be done on-site leading to added convenience to a user. Further, in the various embodiments, partial slabs that remain after cutting a precast slab can also be utilized, leading to reduced wastage of material.

While the invention has been particularly shown and described with reference to specific embodiments, it should be understood by those skilled in the art that various changes, modification, variation in form and detail may be made therein without departing from the scope of the invention as defined by the appended claims. The scope of the invention is thus indicated by the appended claims and all changes which come within the meaning and range of equivalency of the claims are therefore intended to be embraced.

The invention claimed is:

1. A connection assembly for connecting a bolt to a slab, the connection assembly comprising:

a first connection part comprising:

a first clamping member; and a first hollow-tubular-connecting-structure extending from the first clamping member, the first hollow-tubular-connecting-structure having a threaded interior wall and an exterior wall having a first engagement element; and a second connection part comprising:

a second clamping member; and a second hollow-tubular-connecting-structure extending from the second clamping member, the second hollow-tubular-connecting-structure having an interior wall having a second engagement element, wherein an inner diameter of the second hollow-tubular-connecting-structure is equal or larger than an outer diameter of the first hollow-tubular-connecting-structure and wherein the second clamping member comprises an opening providing access to an inner cavity of the second hollow-tubular-connecting-structure, wherein the first connection part and the second connection part are connectable to each other with the first hollow-tubular-connecting-structure of the first connection part and the second hollow-tubular-connecting-structure of the second connection part aligned along a connection axis and directed towards each other such that the first hollow-tubular-connecting-structure is insertable into the second hollow-tubular-connecting-structure to form a connection along the connection axis with the first engagement element of the exterior wall of the first hollow-tubular-connecting-structure and the second engagement element of the interior wall of the second clamping member engaged to each other.

2. The connection assembly of claim 1, wherein the first connection part and the second connection part are capable of being assembled to the slab in a manner so as to sandwich the slab with the first clamping member and the second clamping member between two opposite surfaces of the slab and with the connection axis of the connection between the first hollow-tubular-connecting-structure and the second hollow-tubular-connecting-structure extending through a through-hole in the slab which extends between the two opposite surfaces of the slab, whereby the bolt is connectable to the slab with the connection assembly by screwing the bolt into the first hollow-tubular-connecting-structure of the first connection part for threaded engagement with the threaded interior wall of the first hollow-tubular-connecting-structure through the opening in the second clamping member of the second connection part.

3. The connection assembly of claim 1, wherein the first clamping member comprises an opening providing access to an inner cavity of the first hollow-tubular-connecting-structure of the first connection part, whereby the bolt screwed into the first hollow-tubular-connecting-structure of the first connection part through the opening in the second clamping member of the second connection part is capable of penetrating the first connection part to protrude from the opening of the first clamping member.

4. The connection assembly of claim 1, wherein the first engagement element comprises exterior screw threads, and wherein the second engagement element comprises interior screw threads.

5. The connection assembly of claim 1, wherein the first clamping member further comprises:

an anti-rotation element configured to engage the slab for impeding a rotation of the first connection part about the connection axis.

6. The connection assembly of claim 5, wherein the anti-rotation element comprises a protruding structure extending from the first clamping member in a same extension direction as the first hollow-tubular-connecting-structure.

7. The connection assembly of claim 1, wherein the first clamping member comprises a first plate, and wherein the first hollow-tubular-connecting-structure extends perpendicularly from the first plate.

8. The connection assembly of claim 1, wherein the second clamping member comprises a second plate, and wherein the second hollow-tubular-connecting-structure extends perpendicularly from the second plate.

9. The connection assembly of claim 1, wherein the opening of the second clamping member is a polygonal-shaped opening having a minimum width equal or larger than an inner diameter of the first hollow-tubular-connecting-structure.

10. The connection assembly of claim 9, wherein the opening of the second clamping member is a hexagonal-shaped opening.

11. The connection assembly of claim 1, further comprising:

a welding joint connecting the first hollow-tubular-connecting-structure to the first clamping member.

12. A levelling or lifting system for a slab, comprising:

a connection assembly for connecting a bolt to the slab, the connection assembly comprising:

a first connection part comprising:

a first clamping member; and a first hollow-tubular-connecting-structure extending from the first clamping member, the first hollow-tubular-connecting-structure having a threaded interior wall and an exterior wall having a first engagement element; and a second connection part comprising:

a second clamping member; and a second hollow-tubular-connecting-structure extending from the second clamping member, the second hollow-tubular-connecting-structure having an interior wall having a second engagement element, wherein an inner diameter of the second hollow-tubular-connecting-structure is equal or larger than an outer diameter of the first hollow-tubular-connecting-structure and wherein the second clamping member comprises an opening providing access to an inner cavity of the second hollow-tubular-connecting-structure, wherein the first connection part and the second connection part are connectable to each other with the first hollow-tubular-connecting-structure of the first connection part and the second hollow-tubular-connecting-structure of the second connection part aligned along a connection axis and directed towards each other such that the first hollow-tubular-connecting-structure is insertable into the second hollow-tubular-connecting-structure to form a connection along the connection axis with the first engagement element of the exterior wall of the first hollow-tubular-connecting-structure and the second engagement element of the interior wall of the second clamping member engaged to each other, wherein the first clamping member comprises an opening providing access to an inner cavity of the first hollow-tubular-connecting-structure of the first connection part, whereby the bolt screwed into the first hollow-tubular-connecting-structure of the first connection part through the opening in the second clamping member of the second connection part is capable of penetrating the first connection part to protrude from the opening of the first clamping member;

the slab; and a levelling bolt or a lifting bolt, wherein the first connection part of the connection assembly and the second connection part of the connection assembly are connected to each other in a manner so as to sandwich the slab between the first clamping member of the first connection part and the second clamping member of the second connection part between two opposite surfaces of the slab, wherein the first hollow-tubular-connecting-structure of the first connection part and the second hollow-tubular-connecting-structure of the second connection part are aligned along the connection axis which extends through a through-hole of the slab extending between the two opposite surfaces of the slab and are directed towards each other, and the first hollow-tubular-connecting-structure is inserted into the second hollow-tubular-connecting-structure to form the connection between the first hollow-tubular-connecting-structure and the second hollow-tubular-connecting-structure along the connection axis within the through-hole of the slab, wherein the first engagement element of the exterior wall of the first hollow-tubular-connecting-structure and the second engagement element of the interior wall of the second clamping member are engaged to each other, wherein the levelling bolt or the lifting bolt is connected to the slab, for lifting or levelling the slab, by screwing the levelling bolt or the lifting bolt into the first hollow-tubular-connecting-structure of the first connection part through the opening in the second clamping member of the second connection part, whereby the levelling bolt or the lifting bolt is in threaded engagement with the threaded interior wall of the first hollow-tubular-connecting-structure.

13. The system of claim 12, wherein the lifting bolt comprises a hook at an end of the lifting bolt.

14. The system of claim 12, wherein the levelling bolt has a length greater than a thickness of the slab.

15. A method of levelling a slab, the method comprising:

assembling a connection assembly to the slab, for connecting a bolt to the slab, wherein the connection assembly comprises:

a first connection part comprising:

a first clamping member; and a first hollow-tubular-connecting-structure extending from the first clamping member, the first hollow-tubular-connecting-structure having a threaded interior wall and an exterior wall having a first engagement element; and a second connection part comprising:

a second clamping member; and a second hollow-tubular-connecting-structure extending from the second clamping member, the second hollow-tubular-connecting-structure having an interior wall having a second engagement element, wherein an inner diameter of the second hollow-tubular-connecting-structure is equal or larger than an outer diameter of the first hollow-tubular-connecting-structure and wherein the second clamping member comprises an opening providing access to an inner cavity of the second hollow-tubular-connecting-structure, wherein the first connection part and the second connection part are connectable to each other with the first hollow-tubular-connecting-structure of the first connection part and the second hollow-tubular-connecting-structure of the second connection part aligned along a connection axis and directed towards each other such that the first hollow-tubular-connecting-structure is insertable into the second hollow-tubular-connecting-structure to form a connection along the connection axis with the first engagement element of the exterior wall of the first hollow-tubular-connecting-structure and the second engagement element of the interior wall of the second clamping member engaged to each other, wherein the first clamping member comprises an opening providing access to an inner cavity of the first hollow-tubular-connecting-structure of the first connection part, whereby the bolt screwed into the first hollow-tubular-connecting-structure of the first connection part through the opening in the second clamping member of the second connection part is capable of penetrating the first connection part to protrude from the opening of the first clamping member, wherein the connection assembly is assembled to the slab in a manner so as to sandwich the slab between the first clamping member of the first connection part of the connection assembly and the second clamping member of the second connection part of the connection assembly and with the connection between the first hollow-tubular-connecting-structure and the second hollow-tubular-connecting-structure within a through-hole in the slab; and connecting a levelling bolt to the connection assembly by screwing the levelling bolt into the first hollow-tubular-connecting-structure of the first connection part through the opening in the second clamping member of the second connection part in a manner so as to penetrate the first hollow-tubular-connecting-structure of the first connection part to protrude from the opening of the first clamping member of the first connection part.

16. The method of claim 15, further comprising adjusting a levelling height of the slab to a predetermined height with respect to a ground by screwing or unscrewing the levelling bolt relative to the connection assembly.

17. The method of claim 16, further comprising filling a gap between the slab and the ground with a filler material.

18. The method of claim 17, further comprising disconnecting the levelling bolt from the connection assembly by unscrewing the levelling bolt.

19. The method as of claim 18, further comprising disassembling the connection assembly by separating the second connection part from the first connection part.

20. The levelling or lifting system of claim 12, wherein the first clamping member of the first connection part of the connection assembly further comprises:

an anti-rotation element configured to engage the slab for impeding a rotation of the first connection part about the connection axis.

* * * * *